US007161571B2

(12) United States Patent
Nally et al.

(10) Patent No.: US 7,161,571 B2
(45) Date of Patent: Jan. 9, 2007

(54) TFT DISPLAY CONTROLLER

(75) Inventors: Robert M. Nally, McKinney, TX (US); Masaya Okita, Saitama (JP)

(73) Assignee: Hunet Display Technology Inc., Tokyo (JP)

( * ) Notice: Subject to any disclaimer, the term of this patent is extended or adjusted under 35 U.S.C. 154(b) by 504 days.

(21) Appl. No.: 10/789,457

(22) Filed: Feb. 27, 2004

(65) Prior Publication Data

US 2004/0217932 A1 Nov. 4, 2004

Related U.S. Application Data

(63) Continuation of application No. PCT/JP02/08626, filed on Aug. 27, 2002.

(60) Provisional application No. 60/315,476, filed on Aug. 28, 2001.

(51) Int. Cl.
*G09G 3/36* (2006.01)

(52) U.S. Cl. ..... 345/92; 345/88; 345/90; 345/93; 345/99

(58) Field of Classification Search ..... 345/87–104
See application file for complete search history.

(56) References Cited

U.S. PATENT DOCUMENTS 6,624,813 B1 * 9/2003 Wang ..... 345/441
2002/0149598 A1 * 10/2002 Greier et al. ..... 345/589

* cited by examiner

*Primary Examiner*—Vijay Shankar
(74) *Attorney, Agent, or Firm*—Flynn, Thiel, Boutell & Tanis, P.C.

(57) ABSTRACT

A programmable controller having three well-known components used in display controls but put under the control of a programmable 'sub-field ' timing generator is disclosed. The three well-known components include a Phase Lock Loop (PLL) unit, a Pixel Pipe Line (PPL) unit and an embedded frame buffer. Even though these are well known and understood components, each one is implemented to support the field and sub-field concepts of field sequential color (FSC) as well as non-FSC TFT display devices. The programmable controller also includes some new components that are unique to FSC displays. These new components include a color light sequencer to control the LED controls (or whatever color light source used) and programmable Source and Gate driver controls to accommodate the extremely wide diversification between different display panels.

23 Claims, 25 Drawing Sheets

FIG.28

| 7 | 6 | 5 | 4 | 3 | 2 | 1 | 0 |
|---|---|---|---|---|---|---|---|
| | | | | WAIT | | | |
| NLA | | | | | | | |

FIG.29

| 7 | 6 | 5 | 4 | 3 | 2 | 1 | 0 |
|---|---|---|---|---|---|---|---|
| Cnt | | | | | | | |
| LDA | | | | | | | |

FIG.30

| 7 | 6 | 5 | 4 | 3 | 2 | 1 | 0 |
|---|---|---|---|---|---|---|---|
| NA | | | | | | T | |
| REVM | | | | | | | |

FIG.31

| 7 | 6 | 5 | 4 | 3 | 2 | 1 | 0 |
|---|---|---|---|---|---|---|---|
| NA | | Cnt | | | | | |
| REVW | | | | | | | |

FIG.32

| 7 | 6 | 5 | 4 | 3 | 2 | 1 | 0 |
|---|---|---|---|---|---|---|---|
| NA | | HC | VC | OE | VP | TP | HP |
| OPP | | | | | | | |

TFT DISPLAY CONTROLLER

CROSS REFERENCE TO RELATED APPLICATION

This is a continuation of International Serial No. PCT/JP02/08626 , filed Aug. 27, 2002 (which international application was not published in English), which claims the priority of U.S. Provisional Application No. 60/315,476, filed Aug. 28, 2001.

BACKGROUND OF THE INVENTION

1. Field of the Invention

This invention relates generally to a TFT display controller.

2. Related Background Art

A new and high-performance TFT technology is coming into its own. This new technology is called Field Sequential Color TFT (FSC-TFT) liquid crystal displays. FSC-TFT displays have larger apertures per pixel. This results in better viewing angles and better transmittance of back light.

For colorization of existing typical TFT displays, a technology using color filters is employed. These displays are called color filter TFT displays. The difference in colorization between color filter TFT display systems and FSC-TFT display systems lies in the way of creating a full range of colors from the three primary colors: Red, Green and Blue. In both types of systems, the luminance (called grayscale levels) of the primary color components lies in a quantized gradient between zero (0) and some upper limit (usually 255). By mixing different gradients of the different primary colors, one can create substantially any desired color. Pink, for example, is a mixture of some value of green combined with an upper limit of red and an upper limit of blue. As green becomes closer to the upper limit, pink becomes closer to white.

In a color filter TFT display, all three color components are generated in close proximity to one another in a small area. The small area is called a pixel, and the three separate components are called sub-pixels. The area is so small that the human eye integrates over the area covered by the three separate sub pixels; and the user does not see three separate primary colors, but instead sees one color that is a combination of the three colors. The pixels are arranged in a two-dimensional matrix called a frame. If each pixel is re-generated every 1/30th of a second, then the display is said to be refreshing at 30 Frames Per Second (FPS). Each pixel and each sub-pixel is refreshing at a rate of 30 Hz. FIG. 1 illustrates one example of a frame of a color filter TFT display system.

In an FSC system, the three color components are generated one at a time in a fast repetitive sequence, all in the same sub-pixel location; and the human eye integrates over time the three separate color components. Each component completely fills and time-shares the pixel area, and there is no concept of sub-pixel areas like the color filter TFT display system. Just like in the color filter TFT display system, the pixels in a FSC system are arranged in a two-dimensional matrix called a frame. And just like in a non-FSC system, if each pixel is re-generated every 1/30th of a second, then the display is said to be refreshing at 30 Frames Per Second (FPS).

However, because the FSC system has no concept of sub-pixel areas, there needs to be another way of identifying the individual components of the pixel. In the FSC system, each color component is associated with a field (i.e., a sub-frame) which is a time division of one frame. Because there are three different color components, there are three different color fields, at least one per each color. Each field corresponds to a sub-pixel of a color filter TFT display system. The red component of all the pixels are refreshed during the red field time, all the pixels are refreshed by the green component during the green field time, and all the pixels are refreshed by the blue component during the blue field time. For a FSC system to refresh the screen at a 30-FPS refresh rate, every field will have 1/90th of a second to refresh. In case, for example, four color fields are assigned to one frame, the frame is refreshed using a red field, a green field, a blue field, and then another green field. This is because the human eye is more sensitive to the color green, and some designs take advantage of this sensitivity to achieve a more crisp display. In such a case, for a 30-FPS refresh rate, each field would have to refresh in 1/120th of a second. FIG. 2 illustrates a 3-field FSC frame and FIG. 3 illustrates a 4-field FSC frame. It can be seen that the same color components of all the pixels (i.e. each field corresponding to each sub-pixel) are displayed at the same time as color fields or color planes.

Keeping the foregoing information in mind regarding frames, pixels, and fields, the concept of sub-fields will now be more easily explained. Just as a frame time can be comprised of three or more field times, a field time can be comprised of a number of sub-field times. Sub-fields can best be understood by first examining TFT Active Matrix display technology with reference to FIG. 4. The Matrix is a grid of columns and lines with one pixel having a transistor at each line and column intersection.

The columns are driven with a source current from devices called source drivers. The source drivers pump measured amounts of voltage corresponding to data to be displayed on pixels into the columns. The lines are driven with a voltage from a device called a gate driver. Each column line will always have some amount of current being pumped into them, but the gate voltage is applied to only one line at a time in the form of a pulse. The pulse on the column output of a gate driver will apply a voltage to gates of all the transistors intersecting that line. Each of these transistors will turn on and allow current to flow from the source driver via the columns to a liquid crystal (LC) capacitor of each pixel. Thus, the LC capacitor will charge. Because each column has an independent measured voltage applied to it in correspondence with data to be displayed on the pixel, each LC capacitor will charge to an independent voltage level for that pixel.

As shown in FIG. 4B, each pixel has a liquid crystal ($C_{LC}$ is the capacitance of the liquid crystal capacitor), a TFT transistor and an auxiliary capacitor $C_S$. The voltage $V_{LC}$ controls the liquid crystal in each pixel area independently to control the amount of light that is allowed to pass through the liquid crystal. The line is connected to the gate of the transistor so that when a gate voltage is applied to the line from the gate driver, the gate of the TFT transistor is gated on. If there is a difference between the voltage $V_{LC}$ applied to the liquid crystal in the pixel of FIG. 4B and the voltage $V_{COLUMN}$ of the column, where $V_{DS}$ is not 0V, then current will be allowed to flow through the TFT transistor to equalize the voltage $V_{LC}$ to the voltage $V_{COLUMN}$ of the column. (This current is labeled $I_D$ in FIG. 4 with the arrows indicating the direction of current flow). As the current flows, the voltage $V_{LC}$ across the LC capacitor goes up, and the voltage across the TFT transistor goes down. Transmittance of the liquid crystal is determined by $V_{LC}$. In a normally black liquid crystal, for example, the greater the voltage $V_{LC}$, the more light is allowed to pass through the liquid crystal. After the gate voltage is removed, the current of the TFT transistor is once again blocked and $V_{LC}$ begins to deteriorate due to leak current or the like. As it deteriorates, more and more light is prevented from passing through the liquid crystal. Eventually no light at all will pass through the crystal and the display screen will be black. In a color filter TFT system there are three sub-pixels for each pixel, and individual sub-pixels are combined with red, green and blue color filters. Therefore, the transistor is gated on once per each frame. The light source is a white light. Looking again at the example of a TFT frame of the color filter TFT display shown in FIG. 1, it can be seen that striped filters covering the entire display would be very effective. In a FSC TFT system where there is no concept of sub-pixels, there are at least three color field times in one frame time, and the transistor is gated on at least once in each one color field.

In view of the above discussion regarding TFT displays, it is apparent that the voltage $V_{LC}$ across the LC capacitor is very crucial. This voltage $V_{LC}$ controls the amount of light that can pass through the liquid crystal, and the amount of light determines how bright the color is. The maximum amount of light possible must be allowed to pass through for each of the three different color components, for example, to obtain a white color. The switching ability of ordinary TFT is not perfect, and cannot hold the voltage across the capacitor constant at the desired level even when the TFT transistor is turned off. FIG. 5 (exaggerated to clearly illustrate the problem) demonstrates how this current flow effects the voltage ($V_{LC}$) across the LC capacitor over time.

When passing the maximum light to achieve a white color, for example, it can be seen that not long after the gate of the TFT transistor is turned off (i.e. current stops charging the capacitor) the white color will begin to fade to gray and then to black. The ratio between the time period when current is flowing into verses the time period when current is flowing out of the capacitor is high as the drawing suggests. If the display has N lines (or rows of pixels), then the ratio is 1:N. As a result, it would be desirable to alter this waveform.

However, the waveform represents the period of time of a color field. So in order to modify this waveform, the concept of sub-fields must now be introduced. As shown in FIG. 6 (once again, exaggerated to clearly illustrate the problem), if the current is allowed to flow into the capacitor several times during the life time of the color field, the capacitor can be recharged, thus reducing the range of swing in $V_{LC}$ over the lifetime of the color field. Even though color filter TFT systems are not taking advantage of this technique, it could well be applied to them just as easy as it can to FSC-TFT display systems. Because it is the FSC-TFT systems that are presently taking advantage of this concept, the discussions herein below will be directed to FSC-TFT technology with the understanding that every thing covered can easily be adapted to non-FSC TFT technology, i.e. color filter TFT display systems.

It is therefore a main object of the invention to reduce the power consumption of a TFT display apparatus.

A further object of the invention is to enhance the ability of a TFT display apparatus to display moving images.

SUMMARY OF THE INVENTION

Those objects of the invention are accomplished by providing a TFT display controller comprising:

a frame buffer operational to store TFT display data supplied from outside;

a timing controller;

a pixel pipe line (PPL) operational in response to signals generated by the timing controller to fetch and convert the TFT display data to a desired TFT display format; and TFT display source/gate gate driver controls operational in response to signals generated by the timing controller to control representation of the TFT display data, wherein the frame buffer, timing controller, PPL, and source/gate driver controls are integrated onto a single die In a preferred embodiment of the invention, it is desirable that the PPL outputs fixed data independent from the TFT display data to a source/gate driver controller. More specifically, the TFT display data output from the PPL in a converted format and the fixed data are switched from one to another periodically and in a constant time ratio. As explained later in greater detail, this improves the performance of displaying moving images while reducing the power consumption.

As explained herein before, the invention is not limited to FSC-TFT display devices, but applicable to non-FSC-TFT display devices, i.e. color filter TFT display devices as well. For compatibility among different types of display devices, the TFT display controller is preferably switchable between a mode for FSC-TFT display devices and a mode for non-FSC-TFT display devices.

An embodiment of the invention uses sub-field timing controls to hold the voltage across the LC capacitor as close to constant as possible by pumping smaller amounts of current into the capacitor at periodic intervals over the life of the field time. Not only does this concept provide a crisper image (less flicker, or color variance over the period of the field), it also consumes less power. There are a number of other reasons, discussed herein below, why a FSC TFT system with sub-field controls is more desirable over a color filter TFT system. Some of the problems that are unique to FSC technology and sub-field timing and how programmable controls for field sequential color TFT display devices solves these problems are now set forth in view of the concepts discussed herein before.

FIG. 7 is a graph illustrating a color field time broken down into periods. These periods are Black, White, Color and Color Hold. The horizontal axis of the graph represents the time involved in one color field period. Here are shown the column voltage $V_{COLMN}$, gate voltage, and voltage $V_{LC}$ of the LC capacitor. The column voltage is actually changing to a different value at every line, but the voltage drop across the TFT transistor only matters when the gate to that TFT transistor is on. As can be seen, the voltage drop across the TFT transistor is increased sharply when the TFT is on and decreases slowly when the TFT is off. This relationship between these two voltage drops over time is important to an understanding of the problems that are addressed herein.

With continued reference to FIG. 7, a brief description of the four different time periods of the field is now set forth herein below. Regarding the black time period, periodically darkening the screen to black is known to remarkably improve the ability of displaying moving images not only on a FSC-TFT display but also on a color filter TFT display. Regarding the white time period, in order to drive the pixel to a color state after the black periods, a burst to a maximum or minimum voltage across the TFT is sometime desired. This period is not indispensable, but it does produce a better display quality. Regarding the color time period, a series of LC capacitor charging cycles is required if the voltage drop across the LC capacitor is to remain reality constant. Shortening the sub-field time period contributes is advantageous for reducing the time lag between start and end positions of consecutive scans of images and for providing images of a uniform quality especially in FSC-TFT. As far as the display data remains unchanged, the same waveform is repeated every sub field period within one field. Regarding the color hold time period, although not essential, it will be advantageous to interrupt operations of the source driver and the gate driver to reduce the power consumption.

On their face, combination and timing of black sub field, color sub field, and so on, in sub-field periods can appear to be a relatively simple concept until consideration is given to the diversity of different parameters that affect the overall timing of the display controls. Some of these different parameters that affect such combination and timing characteristics are set forth below.

Regarding the pixel size, usually the larger the pixel area, the larger the LC capacitor. The larger the capacitor is, the more current is required to charge the capacitor with the same voltage. There is an extreme wide range of LCD displays on the market, and it results in a wide range of LC capacitors with a variety of capacitance values on the market.

Regarding the size (in number of pixels) of the display device, there are displays on the market ranging in size from below 160×160 to above 1280×280. The frame rates on these display devices are usually somewhere between 50 and 80 Hz. When looking at the diversity in the number of pixels to be processed and calculating the sub-field rates, a wide range of clock rates must be dealt with.

Regarding the liquid crystal's response time, how fast the liquid crystal reacts to the applied voltage or relaxes after the applied voltage is removed will determine how the voltage can be applied.

In view of the above, it can be seen there is a very small probability that any two different display systems will have the same sub-field timing. This is problematic since each display system will require its own unique timing controller. Such display systems will be expensive because one cannot take advantage of mass production of the electronics to keep the controller cost down. Even different applications of one type of display might require different controllers.

It is therefore desirable to have a programmable timing controller that can be programmed to fit different applications in order to accommodate a wide variety of display systems, each having a different sub-field timing, in order to minimize costs.

The present invention is directed to a controller having three well-known components used in display controls under the control of a novel 'sub-field' timing generator. The controller is preferably programmable if it is desired compatible. The three well-known components described herein below are:

1) A Phase Lock Loop (PLL) unit: Considering the extreme wide range of sub-pixel clock rates discussed herein above, the only way to make a programmable sub-pixel timing controller flexible enough to cover the range of required sub-pixel clock rates is the use of a programmable PLL.

2) A Pixel Pipe Line (PPL) unit: Data is serialized into a stream of pixels (each pixel may be 1, 2, 4, 8, 16, 24, or 32 bits wide) and clocked out to the display, pixel by pixel, line by line and sub-field by sub-field, until the entire frame has been processed. This is the job of the PPL. Some components that may or may not be affected by the PPL include the Color Look Up Table (CLUT), Color Attribute Controls (CAC), bit ordering, and the like. One feature of the PPL that is unique to FSC TFT displays is that more than one pixel will have to be output to the source driver with each output clock.

3) Embedded frame buffer: A quick calculation for a 60 frames per second 320×240 true color (3 bytes per pixel) FSC display of 3 fields of 5 sub-fields each, shows that a 240 Mbytes per second data rate is required to refresh the display. If the display is interactive (user is constantly changing the data content of the display), the overall data rate requirements on the memory could easily exceed 300 Mbytes per second. One way to solve this problem and still keep cost and power consumption down is to integrate the memory onto the same die occupied by the Pixel Pipe Line.

Even though these are well known and understood components, each one is uniquely implemented according to particular embodiments of the present invention in order to support the field and sub-field concepts of FSC. Controllers according to some of embodiments of the invention are programmable, and also include some new components that are unique to FSC displays. These new components include:

1) A color sequencer is included to control the LED Controls (or whatever kind of color light source used). Because the color fields are being displayed one at a time in a repetitive sequence as discussed herein before, the LED (or light source) for each field is illuminated to coincide with when the fields data is presented to the source driver. According to one embodiment, this component may also be used to control the intensity of each light source.

2) Programmable Source and Gate Driver controls are included to accommodate the extremely wide diversification between the different display panels.

BRIEF DESCRIPTION OF THE DRAWINGS

Other aspects, features and advantages of the present invention will be readily appreciated as the invention becomes better understood by reference to the following detailed description when considered in connection with the accompanying drawing figure wherein:

FIG. 28 illustrates a programmable register suitable for use with the integrated programmable FSC TFT LCD controller shown in FIG. 9 to determine when valid data to a source driver can begin;

FIG. 29 illustrates a programmable register suitable for use with the integrated programmable FSC TFT LCD controller shown in FIG. 9 to define the number of valid horizontal shift clock cycles remaining in a line of data after the last valid data of a line is output;

FIG. 30 illustrates a programmable register suitable for use with the integrated programmable FSC TFT LCD controller shown in FIG. 9 to determine if the polarity clock associated with the source driver outputs is toggling on every line or every frame;

FIG. 31 illustrates a programmable register suitable for use with the integrated programmable FSC TFT LCD controller shown in FIG. 9 to define the number of vertical shift clock cycles to wait after the first active edge of the vertical shift clock and after a vertical shift pulse goes active before toggling the polarity clock associated with the source driver outputs;

FIG. 32 illustrates a programmable register suitable for use with the integrated programmable FSC TFT LCD controller shown in FIG. 9 to control the polarity of specific output signals associated with a programmable register suitable for use with the integrated programmable FSC TFT LCD controller.

While the above-identified drawing figures set forth particular embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DESCRIPTION OF THE PREFERRED EMBODIMENTS

Figure 1:
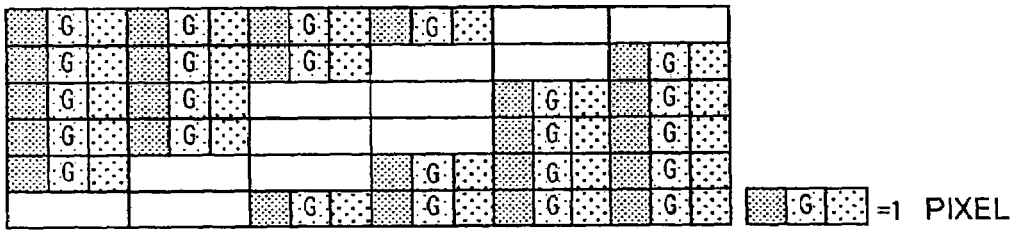
FIG. 1 illustrates one example of a non-FSC frame.
Figure 2:
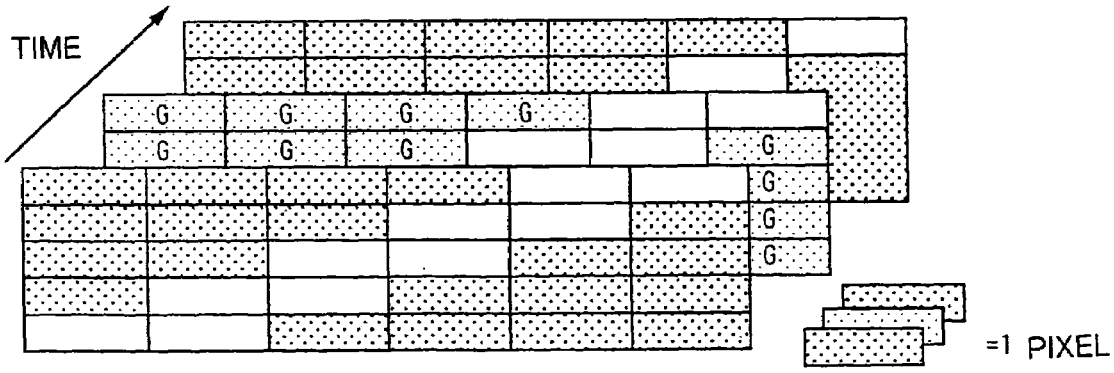
FIG. 2 illustrates one example of a 3-field FSC frame.
Figure 3:
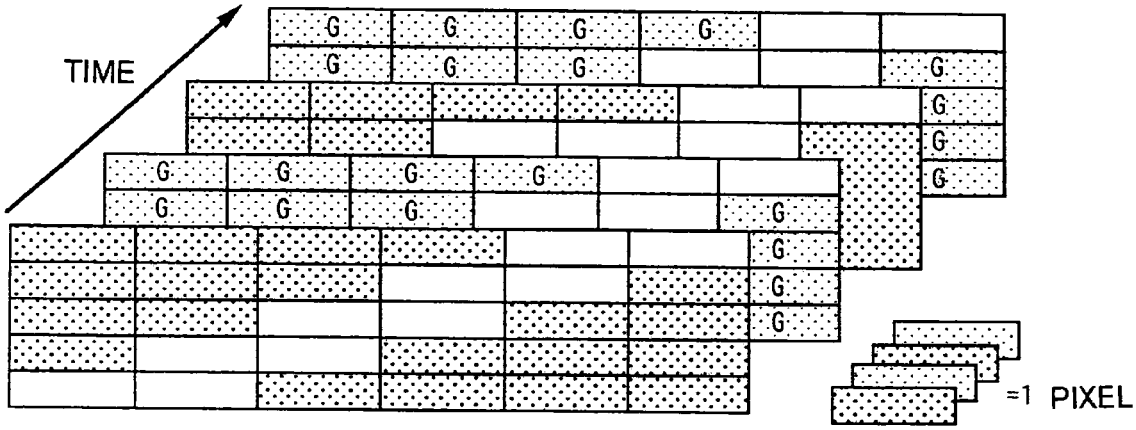
FIG. 3 illustrates one example of a 4-field FSC frame.
Figure 4A:
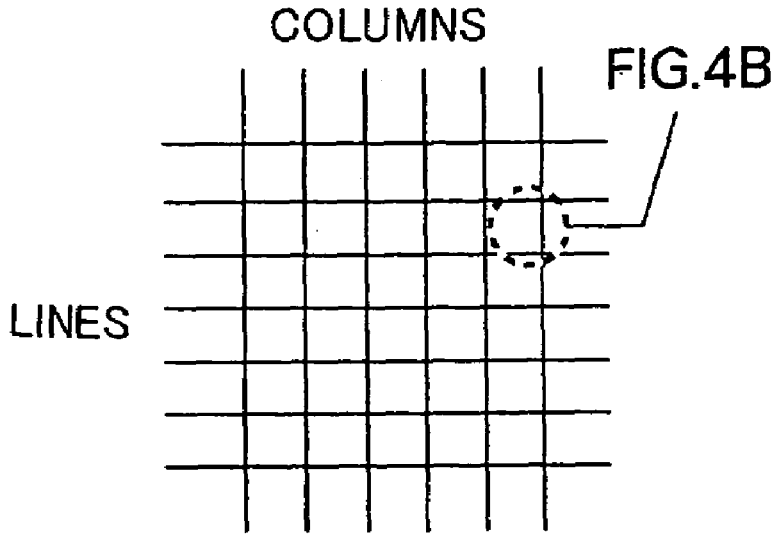
FIG. 4A illustrates the matrix of a TFT active matrix display.
Figure 4B:
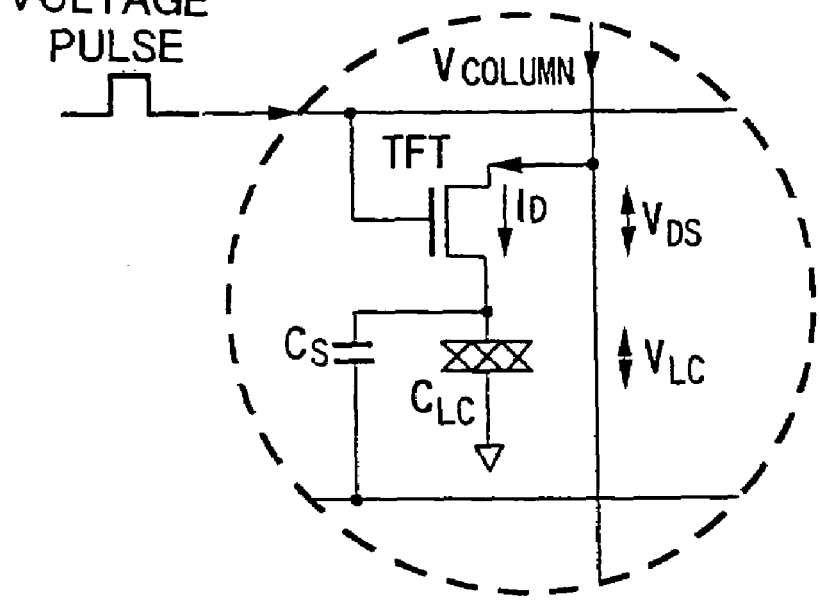
FIG. 4B illustrates an active element portion of an active matrix TFT display.
Figure 5:
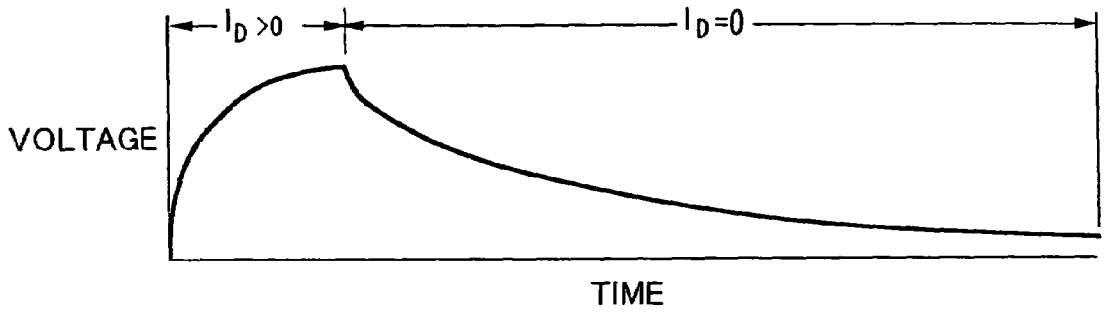
FIG. 5 is a timing waveform diagram illustrating how current flow affects the voltage across the liquid crystal (LC) capacitor within the active element portion of the active matrix TFT display shown in FIG. 4.
Figure 6:
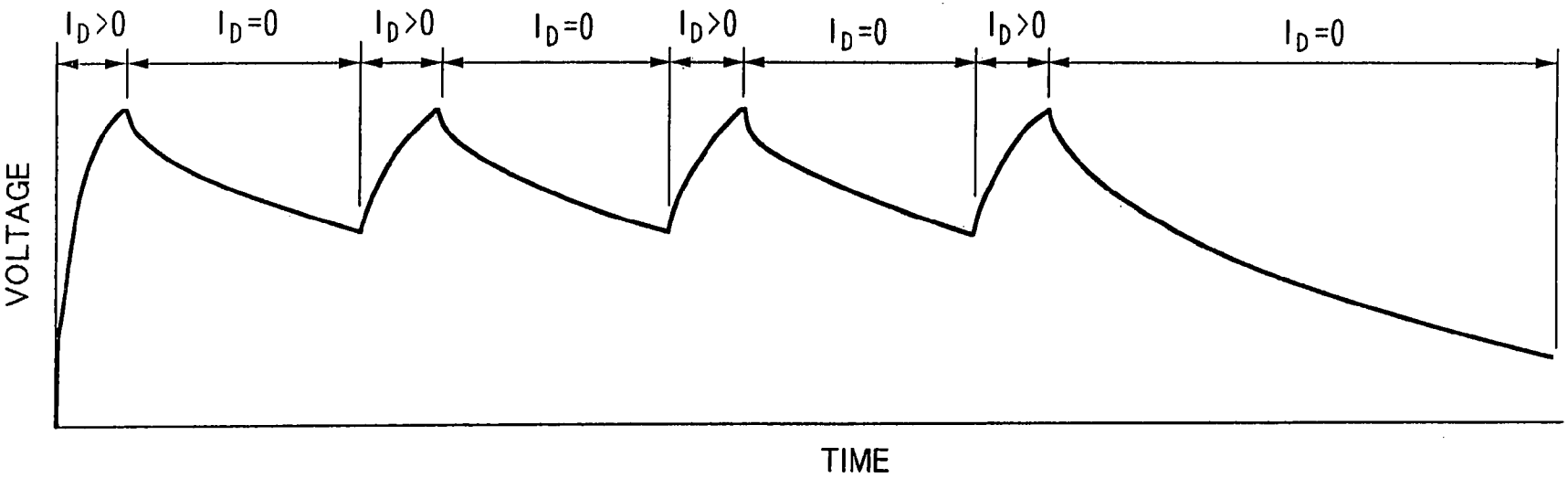
FIG. 6 is timing waveform diagram illustrating a voltage across the liquid crystal capacitor within the active element portion of the active matrix TFT display shown in FIG. 4 that is caused by allowing current to flow into the capacitor several times during the life time of the field.
Figure 7:
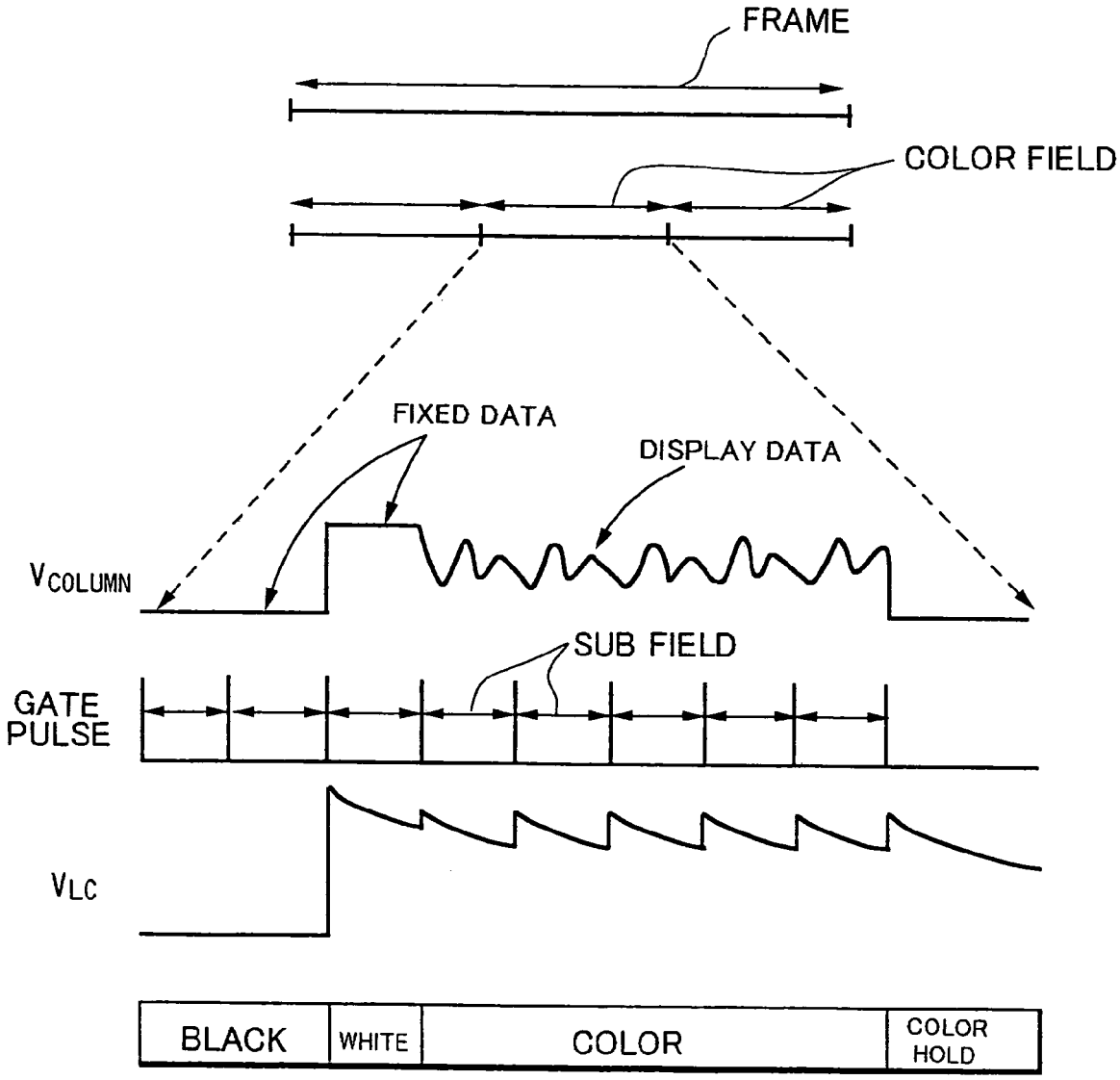
FIG. 7 illustrates how a color field is divided to a plurality of sub-fields.
Figure 8:
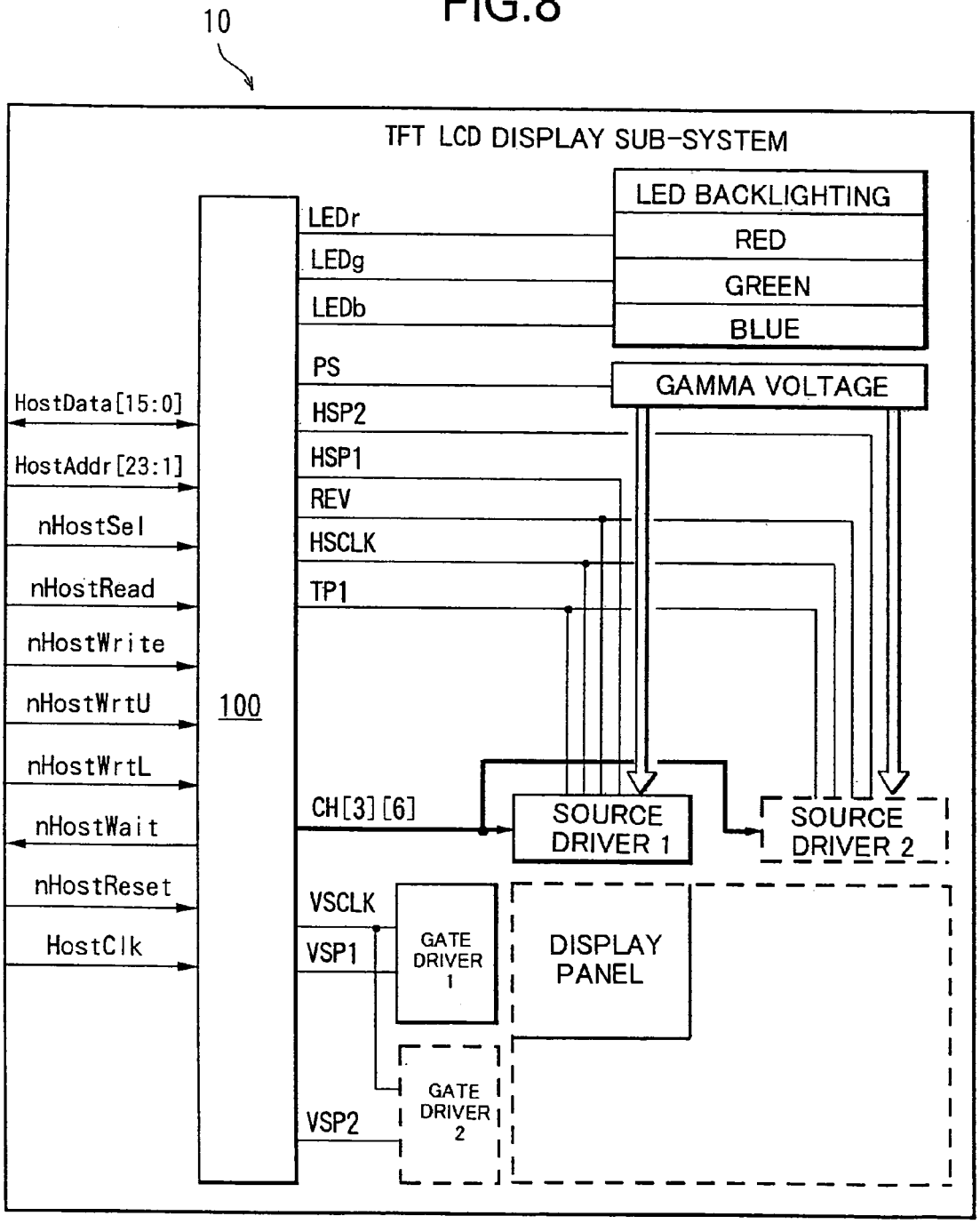
FIG. 8 is a simplified block diagram illustrating one embodiment of a programmable TFT LCD display subsystem.

FIG. 8 is a simplified block diagram illustrating a FSC TFT LCD display sub-system 10 that employs a FSC (Field Sequential Color) display controller 100 integrated into a single chip according to one embodiment of the present invention. The display controller 100 includes some well understood components used in a new and innovating way, and further includes some new components unique to FSC display controls. In addition to having a phase lock loop, a pixel pipe line, an embedded frame buffer, a color light sequencer, and programmable gate and source driver controls discussed herein before, some additional capabilities that are unique to the FSC display controller 100 are directed to Power Management Modes. It can be appreciated that once all the components (e.g. timing controller, pixel pipe line, and memory) are all incorporated onto the same die and programmable flexibility has been added, a great deal of power management can be applied. Precise management of power to each component, for example, can now be achieved through register settings.

Display quality can go through a series of degradation via the different power management levels to achieve longer battery life in any system that incorporates the FSC display controller 100 into its design. When a high quality display is required for user interaction, the display sub-system 10 will consume more power; but when the user is not interacting with the display, it can be set into a low quality display state and consume much less power. It will be appreciated by those skilled in both the FSC TFT and non-FSC TFT display art that this is a very important requirement for portable units.

Figure 9:
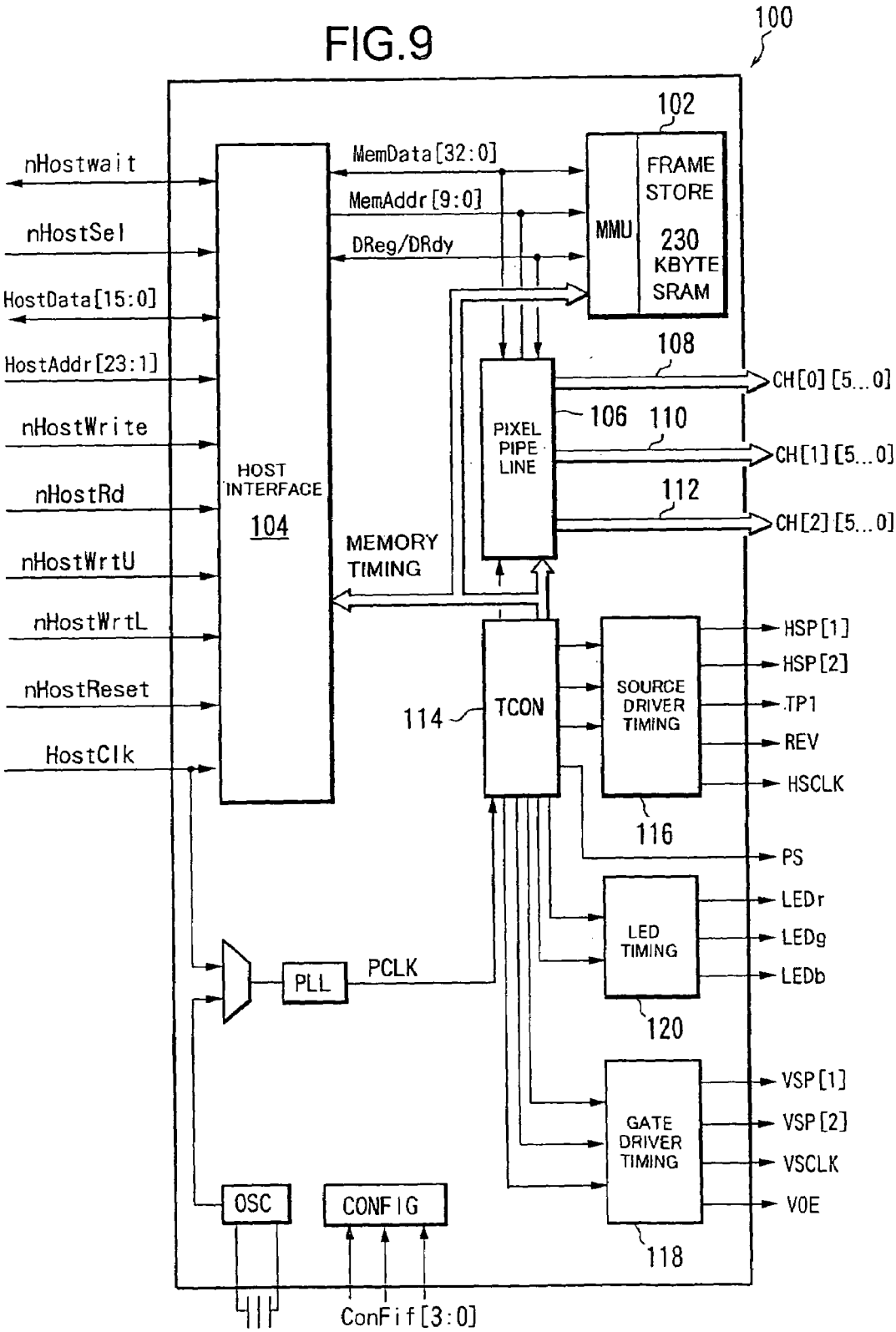
FIG. 9 is a simplified block diagram illustrating one embodiment of an integrated programmable FSC TFT LCD controller having a timing controller, pixel pipe line, embedded frame buffer memory, color light sequencer and programmable source and gate driver controls.

FIG. 9 is a more detailed block diagram of the FSC TFT display controller 100 shown in FIG. 8. The adaptations associated with each component allow interplay among the components to achieve overall results that have never before been achieved or even possible using known display controllers.

Frame Store memory 102 is the embedded memory. All the display data is stored in the Frame Store memory 102. The host processor (e.g. DSP), not shown, can modify the data randomly and at will through the Host Interface unit (Host I/F) 104. Data is stored in the Frame Store memory 102 in either True Color RGB packed pixel format, monochromatic, or palletized format. Display data is fetched from the Frame Store memory 102 by the Pixel Pipe Line unit 106. The Pixel Pipe Line unit 106 will convert the data from which ever format it is in when stored in the Frame Store memory 102 to the field sequential color format required for display by FSC-TFT LCD displays or packed RGB pixel format for conventional TFT LCD displays. A Pixel Pipe Line is a well understood by those skilled in the art and so a detailed description is not presented herein to preserve clarity and brevity. The sub-field support features of the FSC-TFT display controller 100 functional modes requires, however, some unique adaptations to be applied, as stated herein before.

In order to address the wide range of display panel types and resolutions, a Phase Lock Loop (PLL) is required to be implemented in association with the Pixel Pipe Line 106, as also stated herein before. The PLL determines at what frequency data is output on the three data channels, ch[0] 108, ch[1] 110, and ch[3] 112. A very wide range of output frequencies can be programmed into the PLL. The PLL is discussed in further detail herein below in association with a discussion of adaptations associated with the Pixel Pipe Line unit 106. The power management support features discussed herein before also require some unique adaptations also described herein below to be applied.

The Timing Controller (TCon) 114 is an important component associated with operation of the display controller 100. There is extensive programmable select control associated with this component. The Timing Controller 114 also interacts extensively with the other components and coordinates the adaptations of the other display controller 100 components to achieve the system level effects that are unique to the display controller 100.

The Source Driver Timing unit 116 is a programmable element. The waveform of the Source Driver Timing unit 116 outputs and their relationship to each other is programmable controlled.

The Gate Driver Timing unit 118 is also a programmable element. The waveforms of the Gate Driver Timing unit 118 outputs and their relationship to each other are programmably controlled. Further, the relationship between the waveforms of the Source Driver Timing unit 116 outputs and the Gate Driver Timing unit 118 outputs is under program control.

The LED Timing unit 120 is also a programmable element that controls the display panel's back lighting. The shape and relationship of its output waveforms are under program control also under program control.

The Pixel Pipe Line

The requirements of a pixel pipe line are well understood by those skilled in the art and so will not be discussed further except to address a twist added herein. Until now, TFT LCD displays have all displayed data in a packed RGB format. In a conventional (Non-FSC) TFT LCD display, all three components, red, green and blue of each pixel are displayed concurrently as three adjacent sub-pixels in a small area on the display panel. The human eye spatially integrates the three sub-pixels together to achieve one color.

FSC TFT LCD displays however, will display data in a field sequential RGB format. All the sub-pixels are grouped into color fields such that all the red sub-pixels will be in the red field, the green sub-pixels in the green field, and the blue sub-pixels in the blue field. The display will display all the sub-pixels in the red field, then all the sub-pixels in the green field, and so on. Never are all the sub-pixels of any pixel all displayed concurrently. They are displayed sequentially in a very short span of time in the same fixed area on the display screen and the human eye temporally integrates the three sub-pixels together to achieve one color. Because each field has to be refreshed at such a fast rate in order to achieve the requirement of refreshing all the sub-pixels of each pixel in a very short time span, more than one pixel has to be processed in the pixel pipe line at a time. This is achieved by expanding the pixel pipe line into multiple parallel pixel pipes.

Figure 10A:
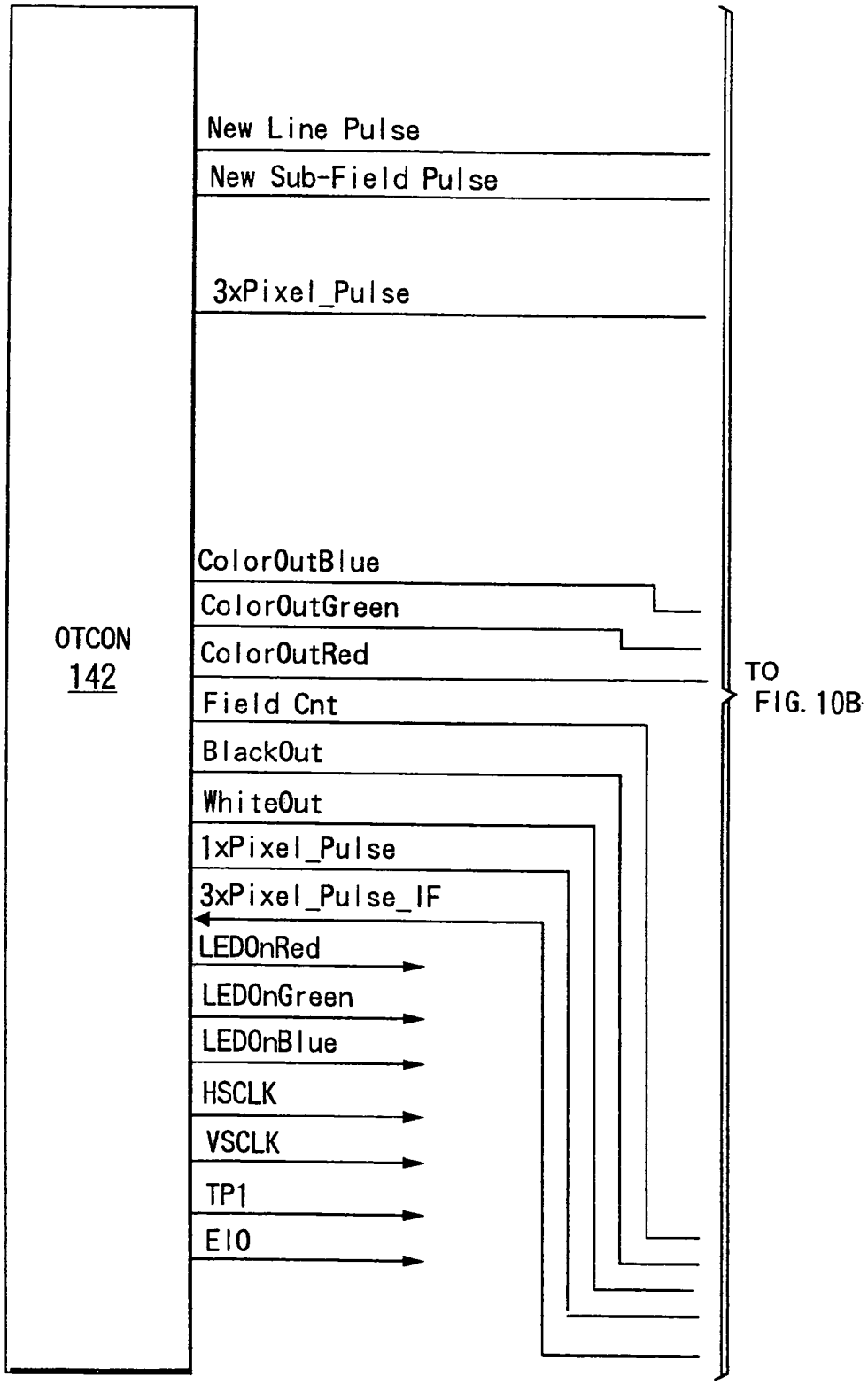
FIGS. 10A and 10B are a more detailed block diagram of the pixel pipe line shown in FIG. 9.
Figure 10B:
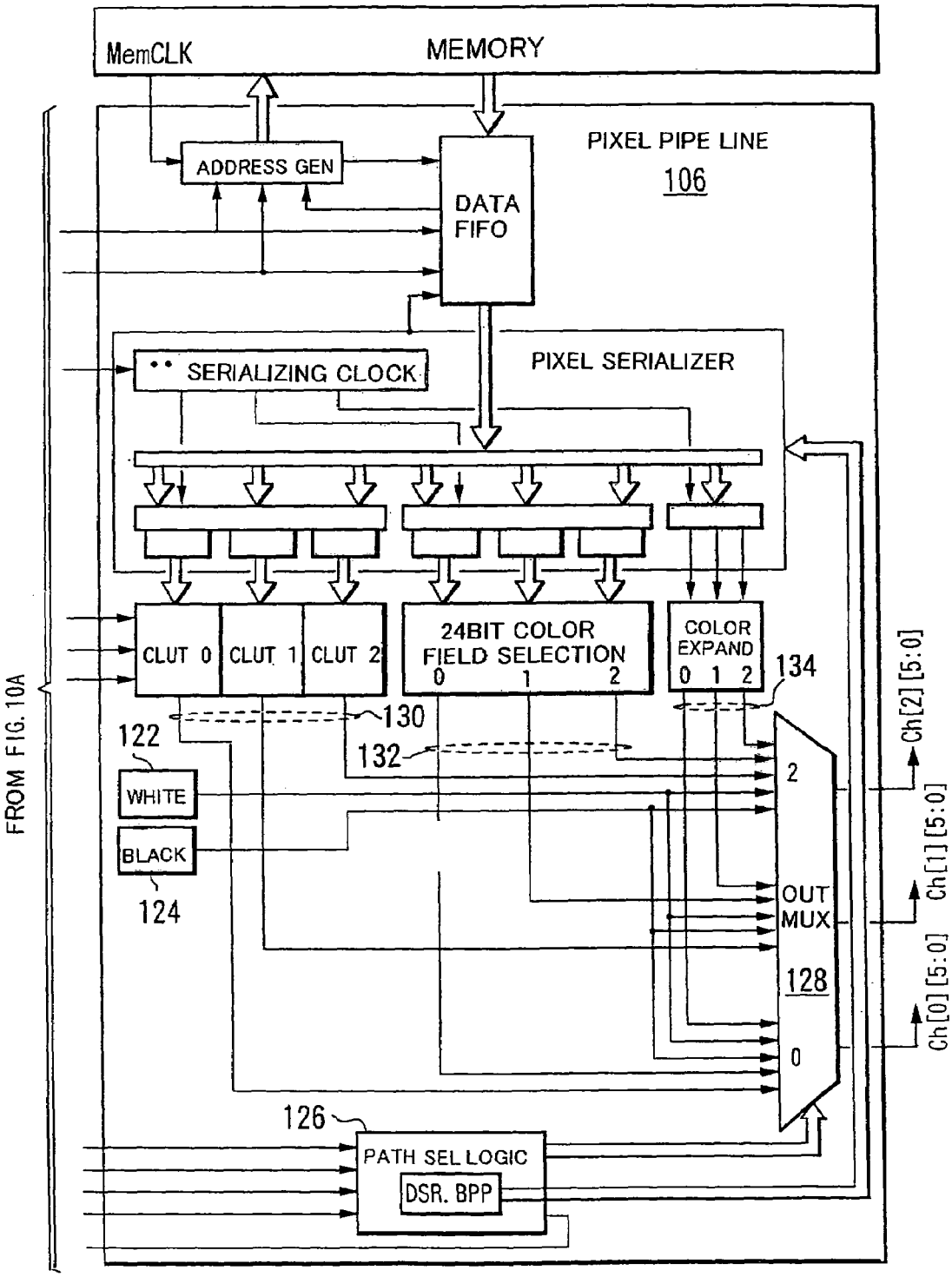

FIG. 10 is a more detailed block diagram illustrating the Pixel Pipe Line unit 106 shown in FIG. 9. The Pixel Pipe Line 106 can be seen to have three parallel pixel pipes. The present invention is not so limited however, and FSC TFT LCD controllers implemented in accordance with the principles of the present invention may have as many as six or nine parallel pixel pipes. Some sub-components of the Pixel Pipe Line 106 will not be further explained herein since they exist and are well understood in the prior art. These sub-components include Color Look Up Tables for palletized data, serializers for serializing the data, address generators for fetching data from memory, and FIFOs for buffering the data to maintain a steady stream of data at the outputs.

The sub-components of interest necessary to implement the novel features associated with the Pixel Pipe Line 106 that will now be discussed in further detail include the White and Black fixed color registers 122, 124, the Path Sel Logic 126, the Out Mux 128, and the three parallel pixel pipes 130, 132, 134. The Pixel Pipe Line unit 106 in the FSC-TFT LCD controller 100 is capable of processing non-FSC data as well as FSC data, sub-field data insertion and performing power management control.

Processing Either Non-FSC Data or FSC Data

Figure 11:
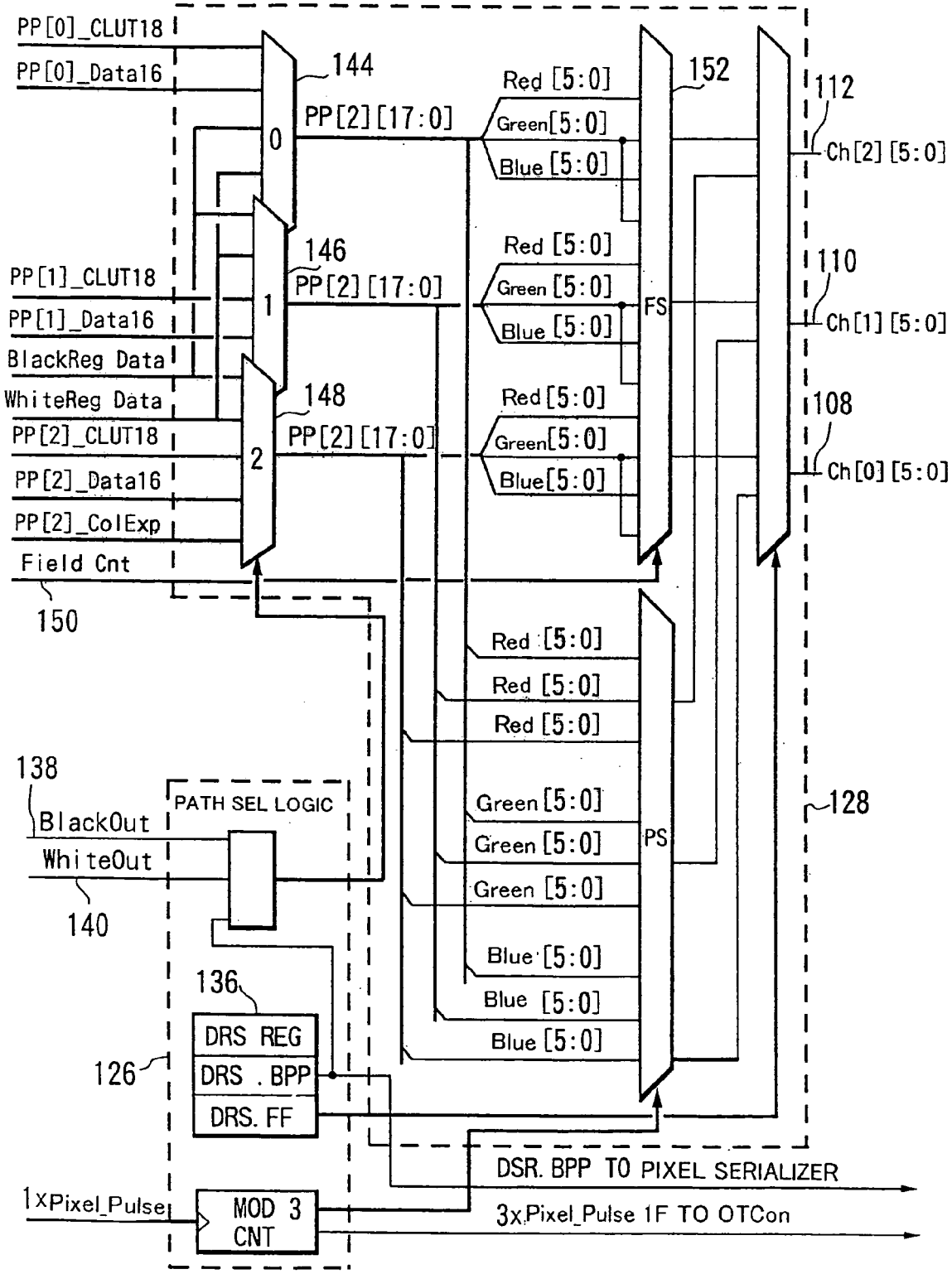
FIG. 11 is a more detailed block diagram of the Out Mux and Path Sel Logic portion of the pixel pipe line shown in FIG. 10.

FIG. 11 is a more detailed diagram of the Out Mux 128 and the Path Sel Logic 126 shown in FIG. 10. The Out Mux 128 has three 5-bit output channels including Ch[0] 108, Ch[1] 110, and Ch[2] 112. The Out Mux 128 can be programmed to output either all three sub-pixels of a single pixel concurrently per clock cycle to drive conventional TFT LCD displays or the same sub-pixel of three adjacent pixels per clock cycle to drive FSC TFT LCD displays. The DRS.FF bit in the DRS (Display Raster Setting) register 136 determines which display format to output.

Sub-field Data Insertion

As stated herein before, two or more of the sub-fields output only black or white data for the black and white periods. In FIGS. 10 and 11, it can be seen that the Pixel Pipe Line 106 has two fixed non-programmable registers 122, 124 labeled White and Black. These two registers 122, 124 are two of the eleven inputs to the Out Mux 128. The other nine inputs to the Out Mux 128 are the outputs of the three parallel pixel pipes 130, 132, 134. Each pixel pipe can be seen to have three optional paths. These include a GLUT path for palletized data, a True Color path for true color data, and a Color Expand path for one bit monochromatic data. All three pixel pipes 130, 132, 134 will always have the same optional path selected as the other two.

If one pixel pipe is using its CLUT internal path, the other two pixel pipes are also using their CLUT internal path. The DRS.BPP bits in the DRS register 136 determine which of the internal paths to select. The BlackOut and WhiteOut signals 138 coming from the TCon (timing controller) unit (designated 142 in FIG. 10) determine when the White and Black registers 122, 124 are selected. The eleven inputs are channeled into three front end multiplexors, [0] 144, [1] 146, and [2] 148. The White and Black registers 122, 124 are inputs to each of the three multiplexors 144, 146, 148. For the remaining input paths, all of pixel pipe zero including (PP[O]_CLUT 18, PP[O]_Data16, and PP[0]_ColExp goes to multiplexor [0]144, all of pixel pipe one similarly goes to multiplexor [1]146, and all of pixel pipe two similarly goes to multiplexor [2] 148.

During white sub-field times, discussed herein below with reference to the TCon (timing controller) 142, the pixel pipes in front of the Out Mux 128 are ideal and consuming minimal power because the data being clocked out of the Out Mux 128 is the content of the White register 122. The same principles apply to the black sub-field times. Which Out Mux 128 input is selected at any time is determined by the Path Sel Logic unit 126. If neither WhiteOut 140 nor BlackOut 138 is active, the input selected by Out Mux 128 is determined by the DRS.BPP bit in the DRS register 136. The Field Cnt (2 bit value) 150 from the TCon unit 142 will determine what color component of the selected input will be output from Out Mux 128. This determination is made in the FS multiplexor 152 in the Mux Out unit 128.

Power Management Control Over the Pixel Pipe Line

The Power Management Control (PMC) register (designated 160 in FIG. 12) can restrict the Pixel Pipe Line 106 power consumption by restricting the Pixel Pipe Line 106 data paths. The PMC.State bits in the PMC register 160 restrict the Pixel Pipe Line 106 as shown in Table 1 below.

TABLE 1

| | | |
|---|---|---|
| PowerDown State | PMC.State = 00 | PPL is completely shut down |
| Standby State | PMC.State = 01 | Only the PP[n]_ColExp data can be output on Ch[n] |
| LowPower State | PMC.State = 10 | Only the PP[n] CLUT18 data can be output on Ch[n] |
| Normal Run Slate | PMC State = 11 | PPL is fully functional |

In the Standby Power State, only the PP[n]_Col.Exp data paths 134 in the pixel pipes are in operation. The three input multiplexors, [0] 144, [1] 146, and [2] 148 of the Out Mux 128 are locked to select only the PP[n]_ColExp input. The FS multiplexor 152 is locked to select only Red[m] data. Each pixel in the Frame Store memory 102 is only a 1-bit pixel. Each frame is only one field with no sub-field. This restriction reduces the screen refresh bandwidth requirements on the Frame Store memory 102 to less than 10 Kbytes per frame. If each frame is refreshed at a low rate of 10 frames per second, the bandwidth requirement on memory is reduced to 0.1 MByte per second. It can be appreciated that lower bandwidth requirements will result in less power lost.

In the LowPower State, only the PP[n]_CLUT18 data paths in the pixel pipes 130 are in operation. The three input multiplexors [0] 144, [1] 146, and [2] 148 of the Out Mux 128 are locked to select only PP[n]_CLUT 18 input. The FS multiplexor 152 is locked to select only Red[m] data. Each pixel in the Frame Store memory 102 is only a 2-bit, 4-bit, or 8-bit pixel. Each frame is only one field with no sub-field. As during the StandBy Power State, this reduces the power consumption of the memory 102 and Pixel Pipe Line 106 by reducing screen refresh memory bandwidth requirements.

The Phase Lock Loop Unit

Figure 12:
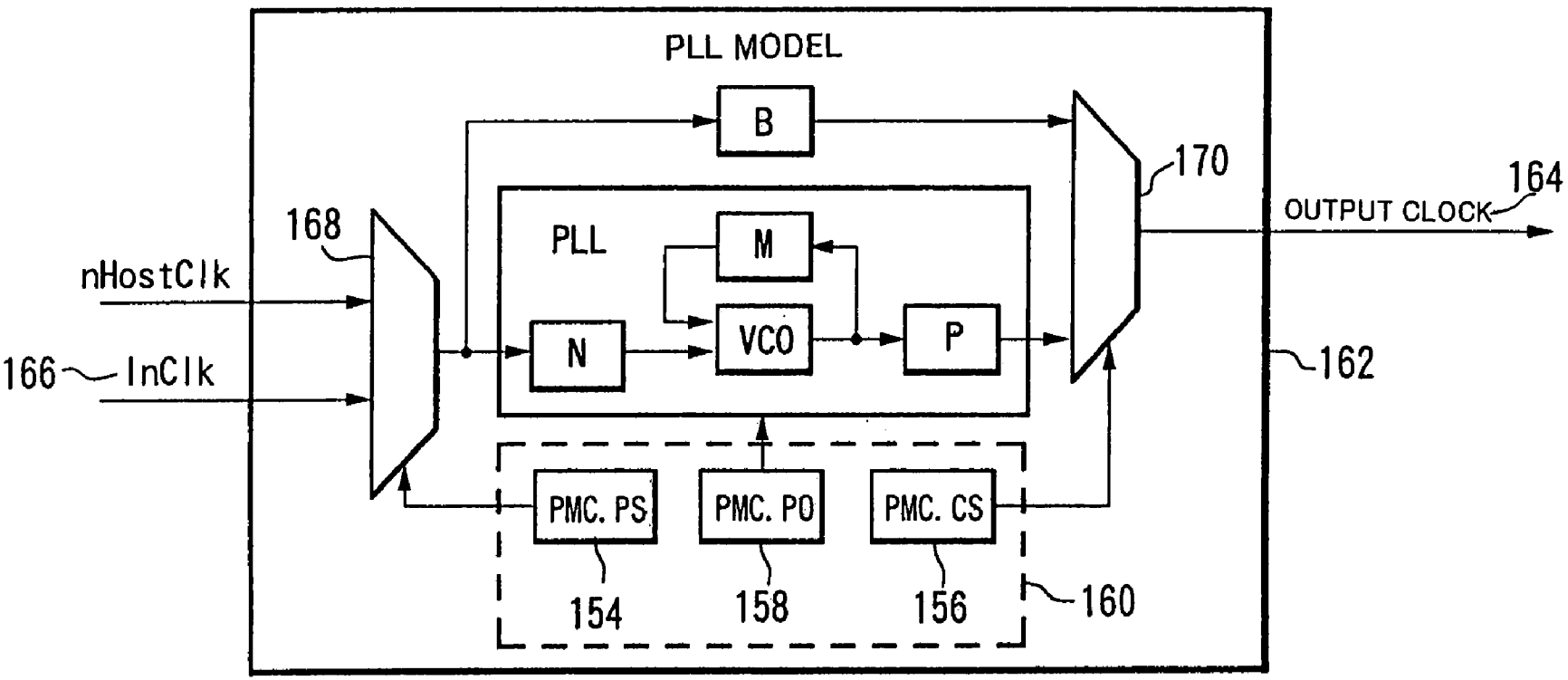
FIG. 12 is a simplified block diagram of the phase lock loop (PLL) shown in FIG. 9.

FIG. 12 illustrates a phase lock loop (PLL) 162 suitable for use with the FSC-TFT display controller 100 depicted in FIG. 9. The PLL 162 generates an Output Clock 164 that is programmably selectable from a number of different sources via the PMC (Power management Controls) register 160. The PMC register 160 can further be used to gate the Output Clock 164 off via the PMC.PO bit 158 in the PMC register 160. The PLL 162 is comprised of four components marked N, VCO, M, and P, wherein the output of the PLL 162 is defined by equations 1 and 2 below.

$$VCO\ \text{freq}=(M/N)*\text{Reference-Clock_freq} \quad (1)$$

$$PLL_\text{Clock_freq}=VCO_\text{freq}/(2P) \quad (2)$$

The units marked M, N, and P are programmable register values. The Reference Clock_Freq 166 applied to the PLL 162 is determined by the PMC.PS bit 154 in the PMC register 160. The PLL_Clock_freq is the PLL 162 output from the unit designated as P in FIG. 12.

The Phase Lock Loop unit 162 includes a Clock Bypass path that includes unit B in FIG. 12 and that allows the PLL 162 to be turned off while retaining a clock output. The Clock Bypass path preferably also comprises a set of programmable selectable frequency dividers to allow further reduction in the output clock rate. The Clock Bypass path between the mux 168 controlled by PMC.PS bit 154 and the mux 170 controlled by PMC.CS bit 156 that goes through the unit marked B is the PLL 162 bypass path. This bypass path is a unique adaptation of the PLL 162 that comprises one portion of the FSC-TFT display controller 100 illustrated in FIG. 9. The PMC.State bits 158 in the PMC register 160 control component B as shown in Table 2 below.

TABLE 2

| | | |
|---|---|---|
| PowerDown State | PMC.State = 00 | No clock is selected |
| Standby State | PMC.State = 01 | The SBCDF register is selected as divide factor for PLL bypass clock |
| LowPower State | PMC.State = 10 | The LPCDF register is selected as divide factor for PLL bypass clock |
| NormalRun State | PMC State = 11 | The NRCDF register is selected as divide factor for PLL bypass clock |

When the PMC.CS bit 156 is selecting the bypass path for the output clock 164, the PMC.PS bit 154 setting, and the PMC.State bits 158 setting determine the output clock 164. Depending on the setting of PMC.State bits 158, whichever clock selected by PMC.PS bit 154 is divided either by a divide factor designated by SBCDF register, a divide factor designated by LPCDF register, or a divide factor designated by NRCDF register. The SBCDF, LPCDF and NRCDF registers are elements within unit B. This extensive programmability of the output clock 164 allows the PLL 162 to be shut down and a slower output clock to be generated in order to save power when the user is not interacting with the display. Note that all the bypass clock output frequencies discussed herein can be pre-determined and programmed before the operation begins; and then by just changing the PMC.State bits 158 in the PMC register 160, can change the output clock 164 rate.

The Timing Controller

As stated herein before, the timing controller in a FSC TFT LCD controller has many more requirements placed on it than does a non-FSC TFT LCD controller. Not only does the FSC TFT LCD controller have to generate the timing controls for the Source Driver and the Gate Driver, it must also generate field and sub-field timing controls for the Pixel Pipe Line and the display panel back lighting. The Timing Controller method of controlling the source and gate timing is discussed in further detail below with reference to the Source Driver and Gate Driver timing units shown in FIG. 18.

The Timing Controller (TCon) unit (designated 114 in FIG. 9) comprises Field and Sub-field controls, back light controls for the display panel and controls associated with the power management modes discussed herein before.

The Field and Sub-field Controls

Figure 13A:
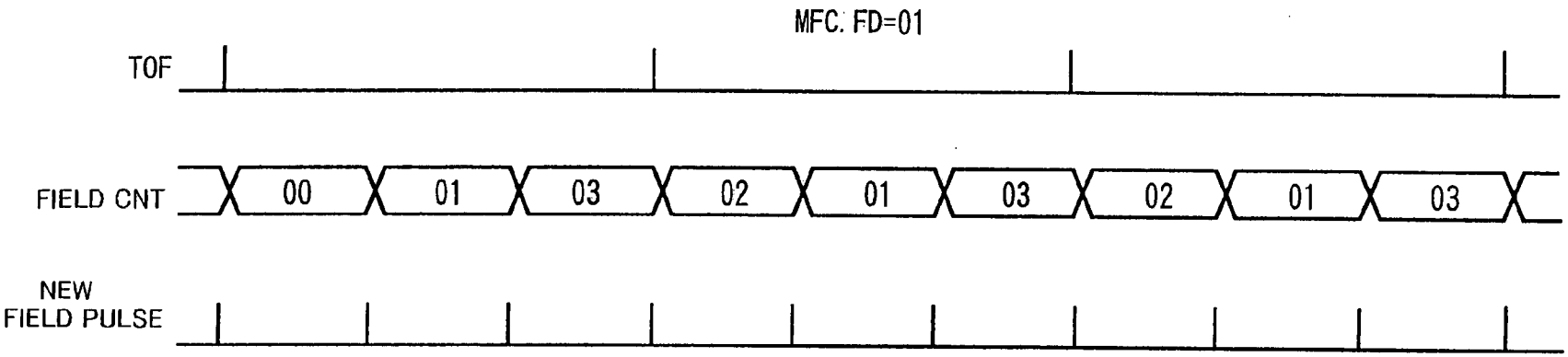
FIGS. 13A and 13B are a frame timing diagrams showing two sequencing orders when the integrated programmable FSC TFT LCD controller shown in FIG. 9 is in FSC Normal Run mode.
Figure 13B:
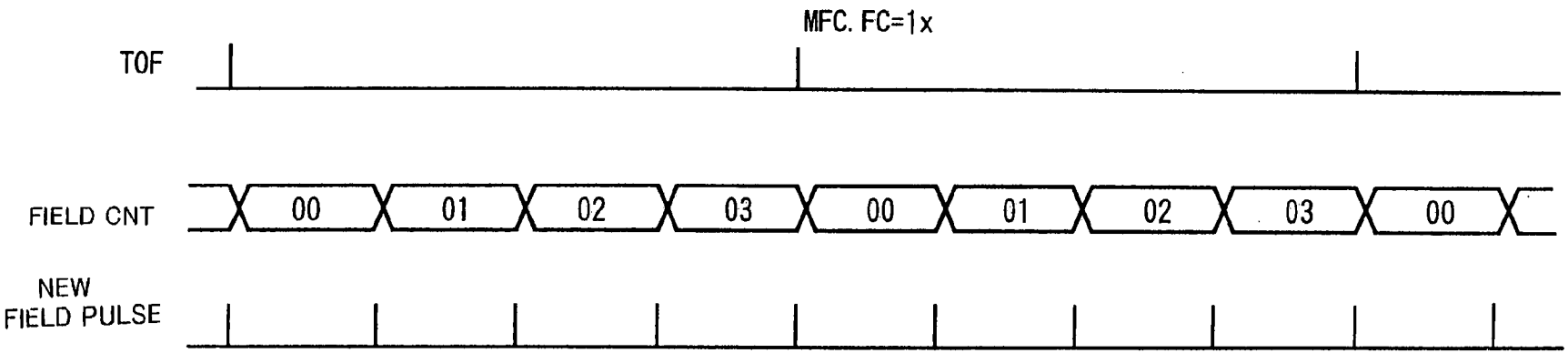

The Field controls within Timing Controller (TCon) 114 are comprised of a counter that counts in 3 or 4 steps, depending on the desired field sequencing order. MFC.FC bits in a Master Field Control (MFC) Register determine the sequencing order. FIG. 13 shows the two sequencing orders when the FSC-TFT display controller 100 is in its FSC NormalRun mode. TCon 114 outputs a Field Count, Red=00, Green=01 and 03, and Blue=02, that is used by the other components in the system to know what field time is being output at any time.

Figure 14:
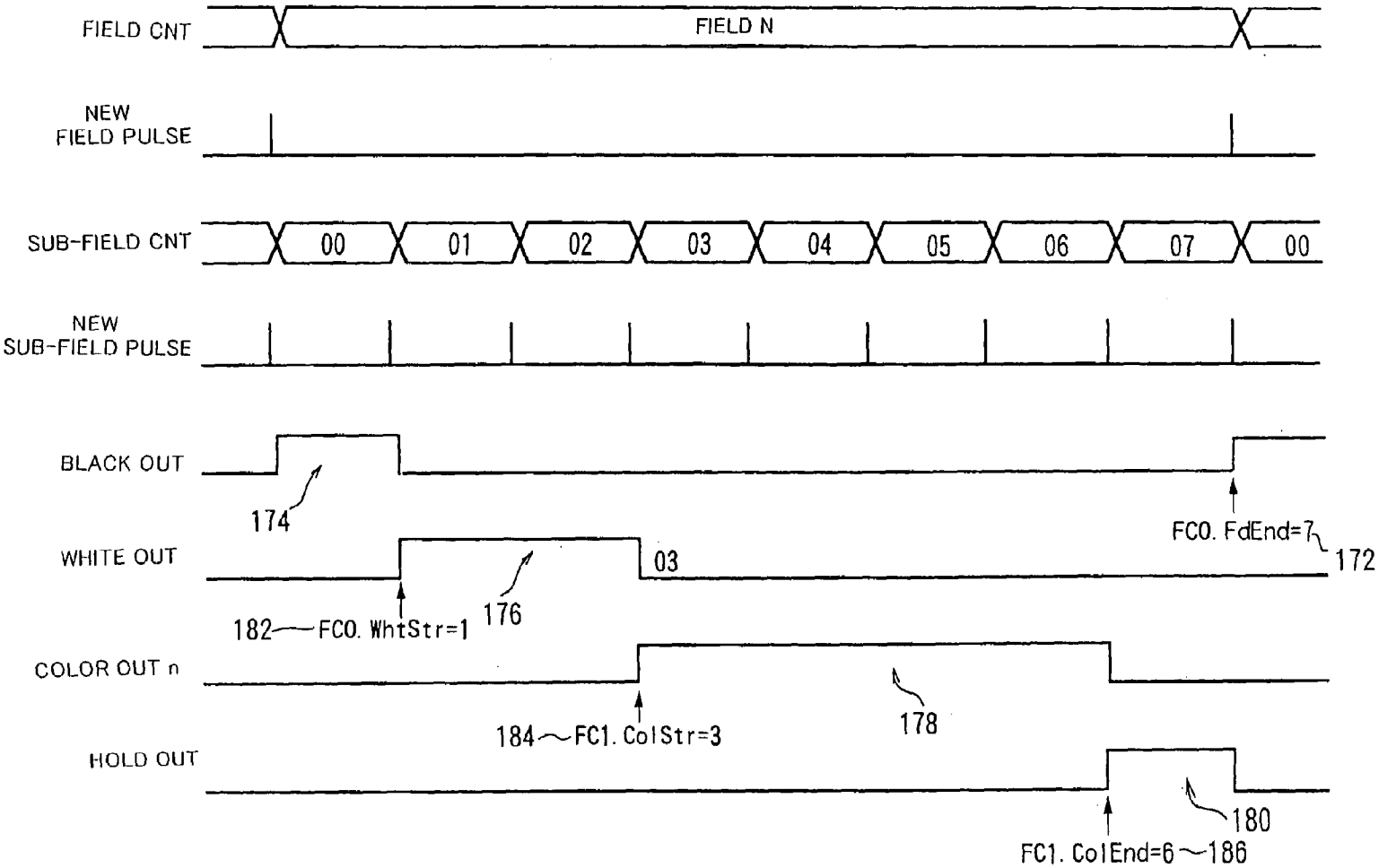
FIG. 14 is a field timing diagram showing how specific field count registers associated with the integrated programmable FSC TFT LCD controller shown in FIG. 9 are programmed to generate one black sub-field, two white sub-fields, four color sub-fields, and one hold sub-field.

The Sub-field controls are substantially more complicated than the Field controls discussed above with reference to FIG. 13. Two additional registers, a Field Count 0 (FC0) and Field Count 1 (FC 1), illustrated in FIG. 14, are required to implement the Sub-field controls. Sub-field timing controls, like Field timing controls, are counter-based. The Sub-field counter can count up to 8, depending on the setting of the FC0.FdEnd bits 172 in the FC0 register. The FC0.FdEnd bits 172 will define the number of Sub-fields in the Field. The counter will count to this value and then reset to zero before starting to count the Sub-fields in the next Field time. The time periods, discussed herein before, are the Black period 174, the White period 176, the Color period 178, and the Color Hold period 180.

The FC0.WhtStr bits 182 in FC0 register determine how many sub-fields long the Black period 174 is. The Black field starts when the Sub-field counter is set to zero and will end when the Sub-field counter equals FC0.WhtStr 182.

When the Black period 174 ends, the White period 176 begins. If FC0.WhtStr 182 is equal to zero, there is no Black period 174 and the first Sub-field is a White sub-field. The Black Out signal is only active during the Black period 174.

The FC1.ColStr bits 184 in the FC1 register determine how many sub-fields will be associated with the White Period 176. The White field 176 starts when the Sub-field counter equals FC0.WhtStr 182 and will end when the Sub-field counter equals FC1.ColStr 184. When the White period 176 ends, the Color period 178 begins. If FC1.ColStr 184 is equal to zero or is less than FC0.WhtStr 182, there is no White period 176.

If FC1.ColStr 184 is equal to zero, the first sub-field is a Color sub-field 178. The White Out signal is only active during the White period 176. The FC1.ColEnd bits 186 in the FC1 register determine how many sub-fields will be associated with the Color period 178. The Color field starts when the Sub-field counter equals FC1.ColStr 184 and will end when the Sub-field counter equals FC1.ColEnd 186. When the Color period 178 ends, the Color Hold period 180 begins. If FC1.ColEnd 186 is equal to zero or is less than FC1.ColStr 184, there is no Color period 178. If FC1.ColStr 184 is equal to zero, the first sub-field is a Color Hold sub-field.

If FC1.ColEnd 186 equals FC0.FdEnd 172, there is no Color Hold period 180. With continued reference to FIG. 14, the FC0 and FC1 registers are shown programmed to generate one Black Sub-field, two White Sub-fields, four Color Sub-fields and one Hold Sub-field for "Field n" and "Color Out n" where n=[Red, Green or Blue].

The Back Light Controls for the Display Panel

Figure 15:
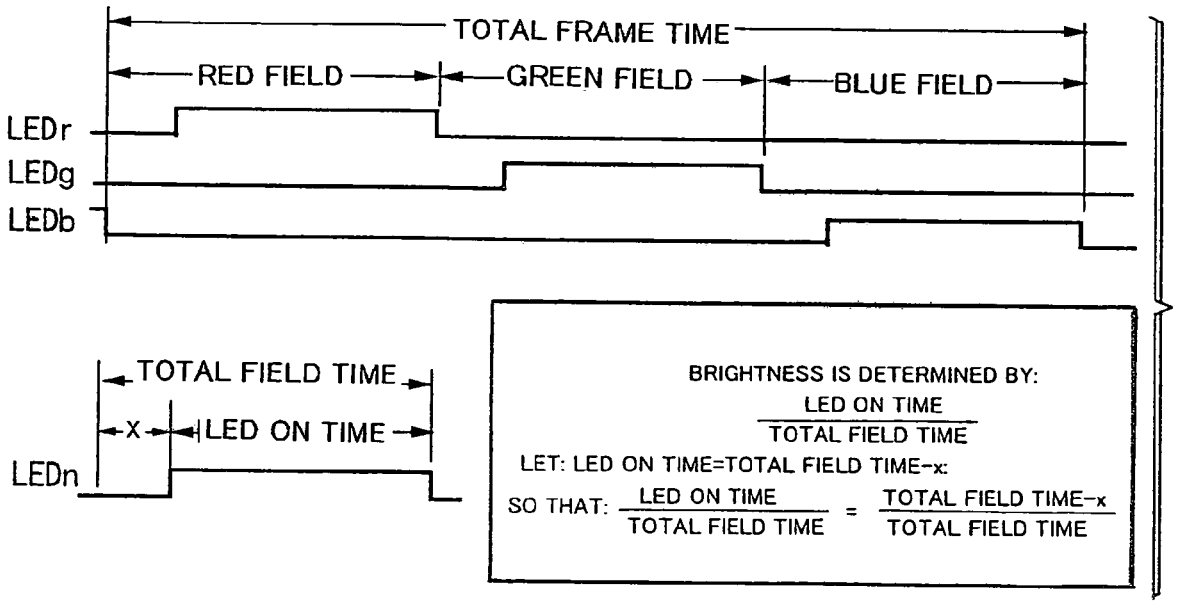
FIG. 15 is a waveform timing diagram illustrating sequential control of red, green and blue light sources to create the back light for a FSC TFT LCD display.

The back light of a FSC TFT LCD display is not generated from a single white light source like those used in non-FSC TFT LCD displays. Instead, the FSC TFT LCD display back light is comprised of three light sources including a Red, a Green and a Blue light source. These light sources must be switched on and off in the correct sequencing order and must be synchronized with the field selections in the Pixel Pipe Line 106 as shown in FIG. 15. The LEDr signal is used to gate the Red back light on, the LEDg signal gates the Green back light on, and LEDb gates the Blue back light on.

FIG. 15 also depicts an equation for determining how long (during the Field time) the light is allowed to be on or emitting light to control the brightness of the back light. The Field counter controlled by the Master Field Controls (MFC) register will determine during what Field time the LEDr, LEDg and LEDb signals are allowed to be active, but does not determine whether or not they are active. Another set of registers, the LEDr, LEDg and LEDb registers, determines whether or not the LEDr, LEDg and LEDb signals are active, which in turn determines the brightness of each color by determining how long each LED is allowed to emit light.

Figure 16:
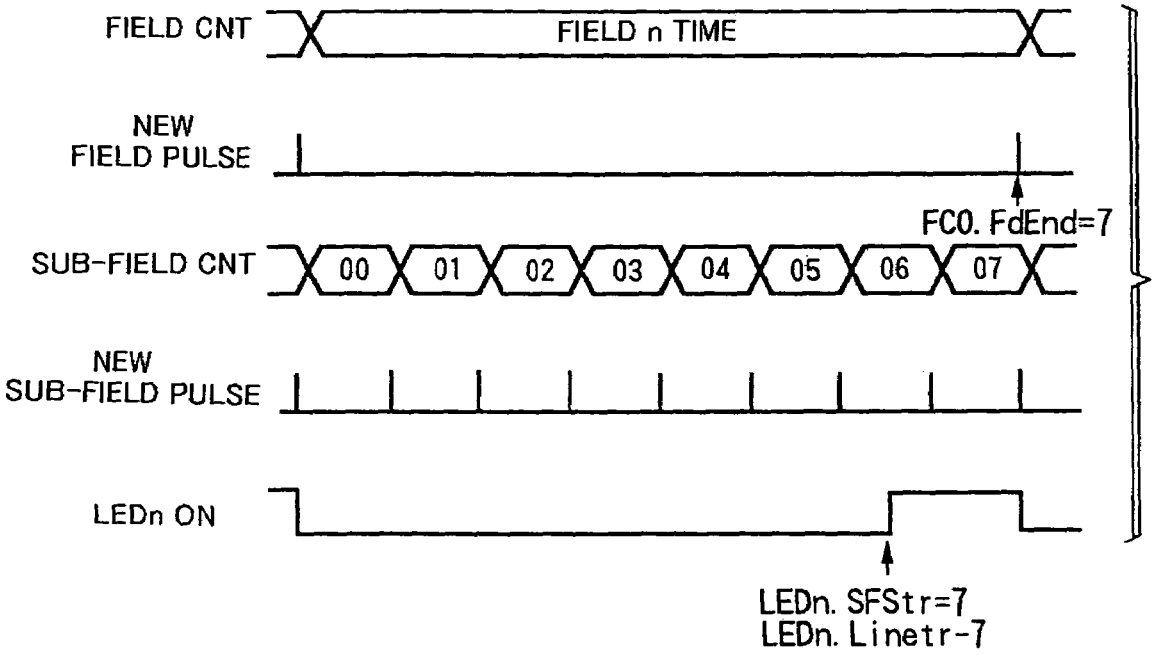
FIG. 16 is a waveform timing diagram illustrating a back light control technique for the integrated programmable FSC TFT LCD controller shown in FIG. 9.

With reference now to FIG. 15, during Field time n (n red, green or blue), "LEDn On" (n=r, g or b) becomes active according to the following rules. First, the LEDn.SFStr bits in the LEDn register define which Sub-field during Field n, the "LEDn On" signal becomes active. Second, the LEDn-.LineStr bits in the LEDn register define during which line refresh time of Field n and Sub-field LEDn.SFStr the "LEDn On" signal becomes active. FIG. 16 shows that the "LEDn On" signal becomes active during the refreshing of the seventh line of the sixth Sub-field of Field n, at which time the n back light begins to emit light. The "LEDn On" signal will remain on until the end of Field n. This method of back light control is employed when the FSC-TFT display controller 100 is configured as a FSC TFT LCD controller with Sub-field timing active and is running in the NormalRun power state (PMC.State=11).

It can be appreciated that eliminating the LEDn registers would eliminate brightness control and the "LEDn On" signals would all be active for the full duration of their respective field times. If there is no consideration given to sub-fields, a degenerative version of this method of brightness control could be used in which LEDn would count only line refresh times. This method of back light control is employed when the FSC-TFT display controller 100 is configured as a FSC TFT LCD controller without Sub-field timing active and is running in the NormalRun power state (PMC.State=11).

It can also be appreciated that if there is no consideration of Fields, another method has to be used and a different set of registers must be used. This is the case when the FSC-TFT display controller 100 is in the StandBy power mode (PMC.State=01). As stated herein before, only 1-bit pixels are used when in StandBy power mode. Each pixel is either black or a color. The color is defined by the back light setting. Registers shown in FIG. 17 control this setting. The Common StandBy Color (SBCc) register 188 defines the maximum period of time (in units of line refresh time) each LEDn signal is allowed to be active (where n=[r, g or b]).

Figure 17:
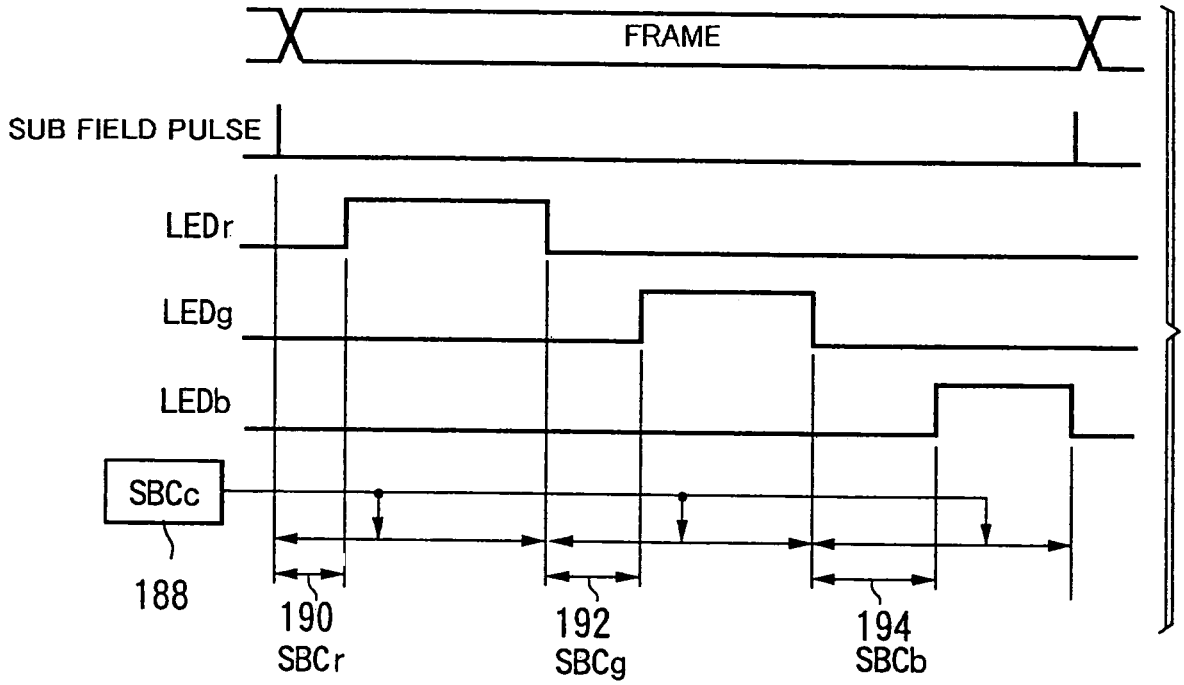
FIG. 17 is a waveform timing diagram illustrating a standby timing technique for the integrated programmable FSC TFT LCD controller shown in FIG. 9.

If all three LEDn signals are active for the full time programmed into SBCc register 188, the back light color will be white. Each LEDn signal also has an associated SBCn register which defines how many units of line time that each LEDn is not active during its allocated period of time. If the SBCr register 190 is programmed with a zero value and both the SBCg register 192 and SBCb register 194 are each programmed with the same value programmed into the SBCc register 188, the back light color would be red. FIG. 17 illustrates a graphical model of this concept.

The Source and Gate Driver Timing Units

Figure 18:
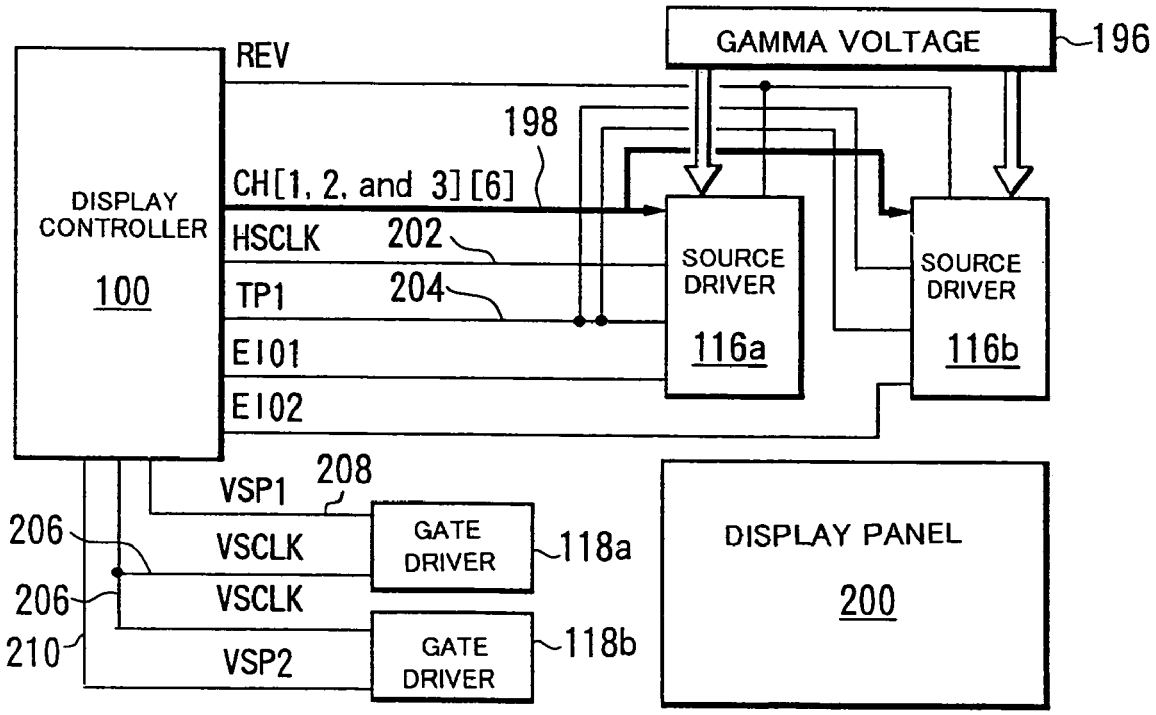
FIG. 18 is a simplified block diagram illustrating a display system using the integrated programmable FSC TFT LCD controller shown in FIG. 9 in association with source drivers including gamma voltage, gate drivers, and a display panel.

FIG. 18 is a simplified block diagram illustrating one configuration of the FSC-TFT LCD display controller 100, Source Drivers 116*a*, 116*b*, Gate drivers 118*a*, 118*b*, and the display panel 200. Also shown is the gamma voltage 196 used by the Source Drivers 116*a*, 116*b* to generate the source current representing the pixel values. The Source Driver 116*a*, 116*b* receives into its input buffer the pixel data CH[n] [m] 198 from the LCD display controller 100 in a streaming format where CH[n] [in] are the three output channels of the Pixel Pipe Line 106. The pixel stream(s) are clocked into the Source Driver's buffer 116*a*, 116*b* with the HSCLK clock 202. The input buffer holds one full line of pixel data. All the pixels for one single line clocked into the input buffer are transferred to the output buffers inside the Source Driver 116*a*, 116*b* all at the same time with the TP1 clock 204. There is a source driver output (or three in the case of Non-FSC TFT displays) for every pixel in a row of display pixels.

All outputs of the Source Driver 116*a*, 116*b* are driving concurrently. The HSP[n] signal (shown in FIG. 8) informs source driver n when to begin receiving a new line of data into its input buffer. The Gate Driver 118*a*, 118*b* receives no data, only clocking information. Every time the FSC TFT LCD display controller 100 generates a TP1 clock 204 pulse to the Source Driver 116*a*, 116*b*, it must generate a pulse on the VSCLK clock 206 going to the Gate Drivers 118*a*, 118*b*. The VSCLK clock 206 informs the Gate Drivers 118*a*, 118*b* to start draining current from the next row or line because the Source Driver 116*a*, 116*b* is now driving current representing the pixels on that row. The Gate Drivers 118*a*, 118*b* generate one current drain driver for every row of pixels on the display panel 200. Only one current drain driver is draining current at any given time. The VSP[1] signal 208 is used to indicate when the first Gate Driver 118*a* should drive the current drain for the first row of pixels. The VSP[2] signal 210 is used to indicate when the second Gate Driver 118*b* (if one is in the system design) should drive current drain for the first row it is attached to. Never should the two Gate Drivers 118*a*, 118*b* be driving current drain at the same time. Table 3 below sets forth definitions of the signals depicted in FIG. 18.

TABLE 3

| | |
|---|---|
| CH[O] [5-O], CH[1] [5-O], CH[2] [5-O] | Three 6-bit data channels going to the Source Drivers |
| HSCLK | Horizontal Shift Clock used to clock data into Source Drivers |
| TP1 | Transfer clock used by the Source Drivers to transfer data from the shift registers to the output registers |
| HSP1, HSP2 | Start Enable signals (one per Source Driver) used by the Source Drivers to clear their shift registers in order to accept another row of data from the three input channels |
| REV | Polarity clock used to define the polarity of the Source Driver outputs |
| VSCLK | Vertical Shift clock used to shift or advance the gate enable pulse to the next row on the display |
| VSP1, VSP2 | Vertical Start Pulses (one per Gate Driver) used to start another gate enable pulse to be advanced or walked from output gate to output gate in the Gate Drivers |

Figure 19A:
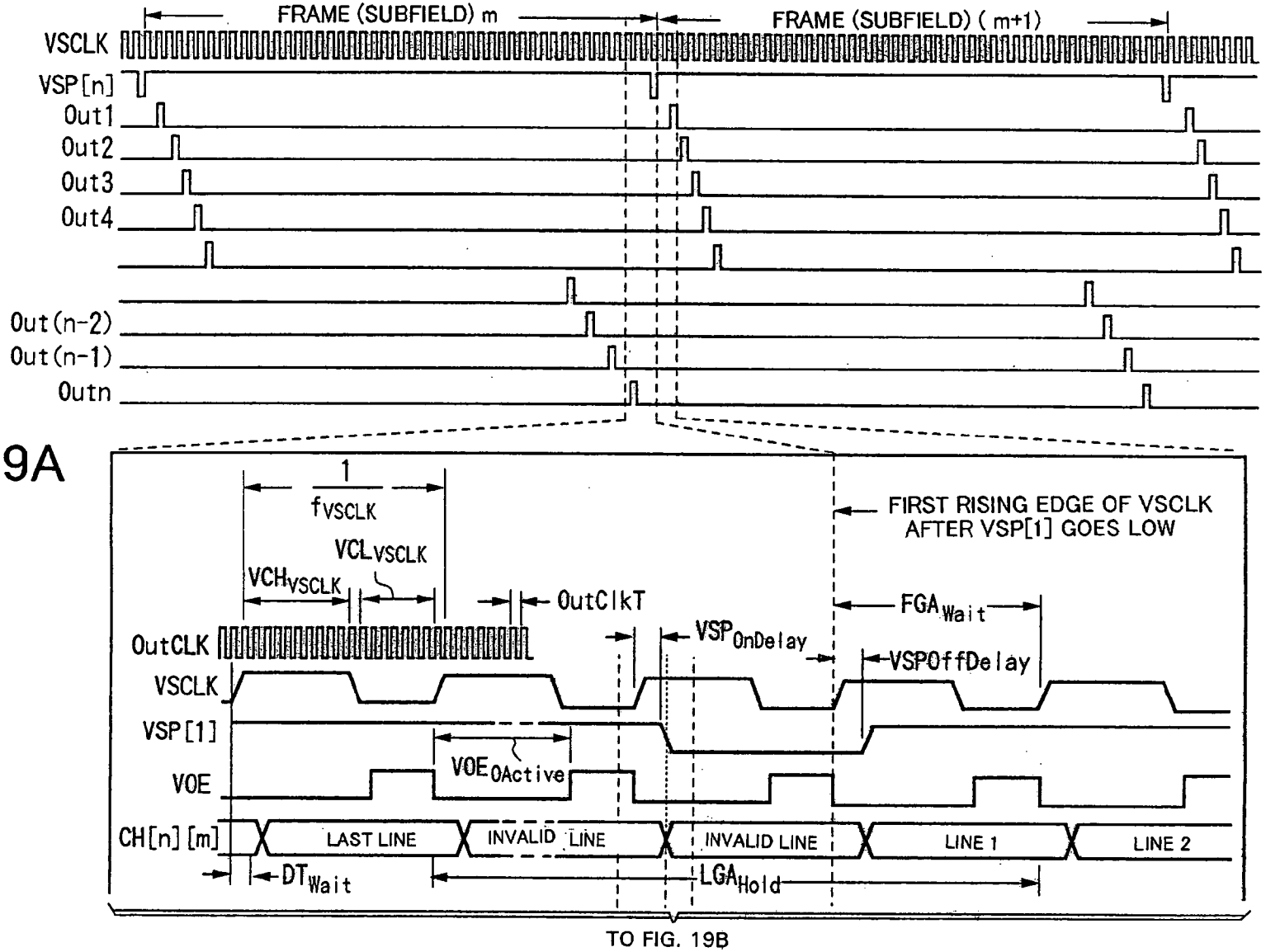
FIGS. 19A and 19B are a waveform timing diagram illustrating all the LCD output (source and gate input) timing signals over a two frame (for a typical non-FSC TFT LCD) or two sub-fields (for a typical FSC TFT LCD) period.
Figure 19B:
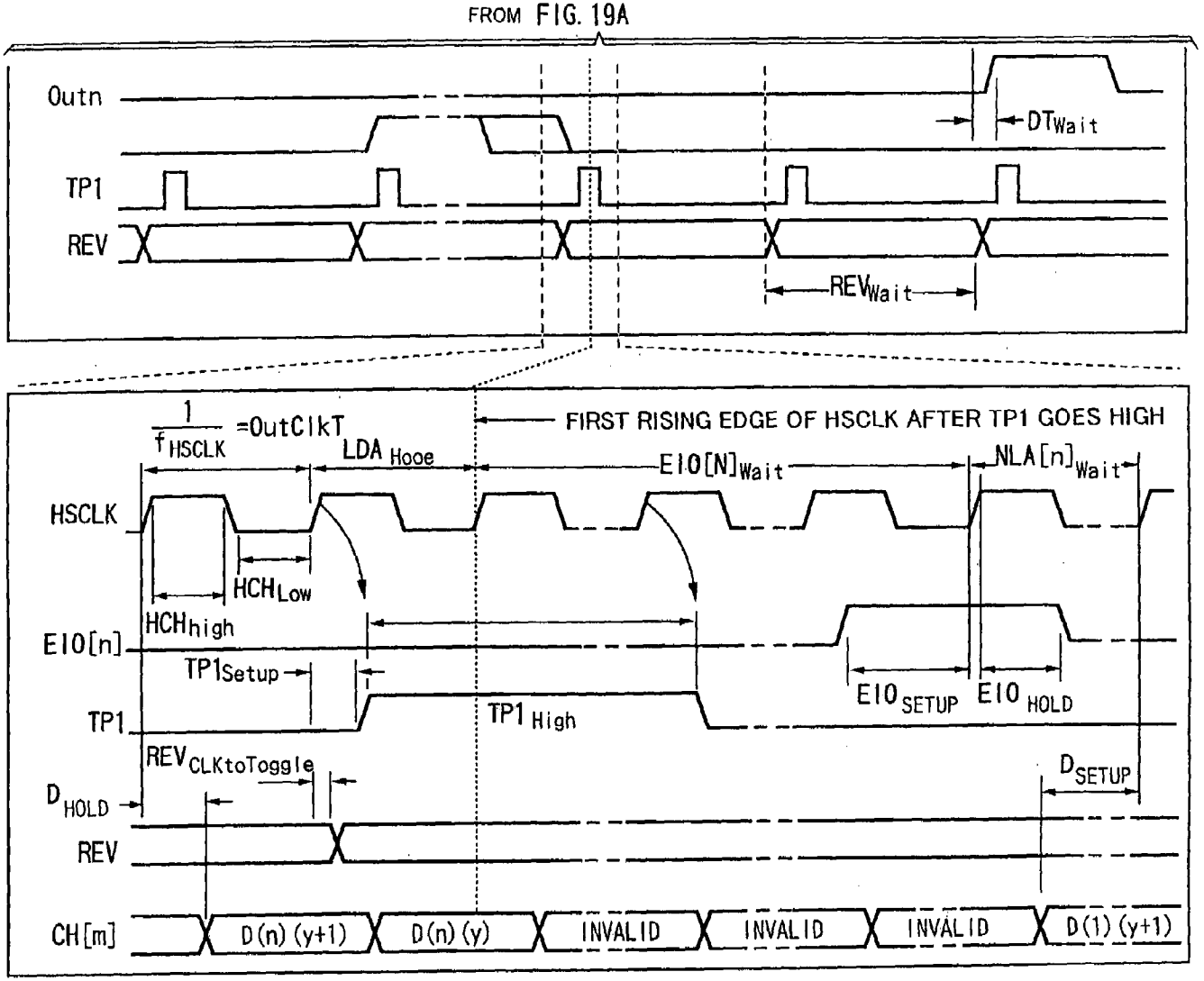

FIG. 19 is a waveform timing diagram illustrating all the LCD display 100 output (source and gate input) timing signals over a two frame (for a typical Non-FSC TFT LCD) or a two sub-field (for a typical FSC TFT LCD) period gate output signal (Outx) are shown for clarity.

A detailed description of the registers that control the timing parameters related to the waveforms depicted in FIG. 19 is now set forth herein below with reference to FIGS. 20–32. The word Frame, as used herein, refers to the raster time of one complete screen refresh cycle. If the LCD panel 200 is a NON-FSC TFT LCD panel, one complete refresh cycle is in fact a Frame; but if it is a FSC TFT LCD panel, one complete refresh cycle is a sub-field. Therefore when dealing with FSC TFT LCD timing, the word Frame is in reality a Field.

Figure 20:
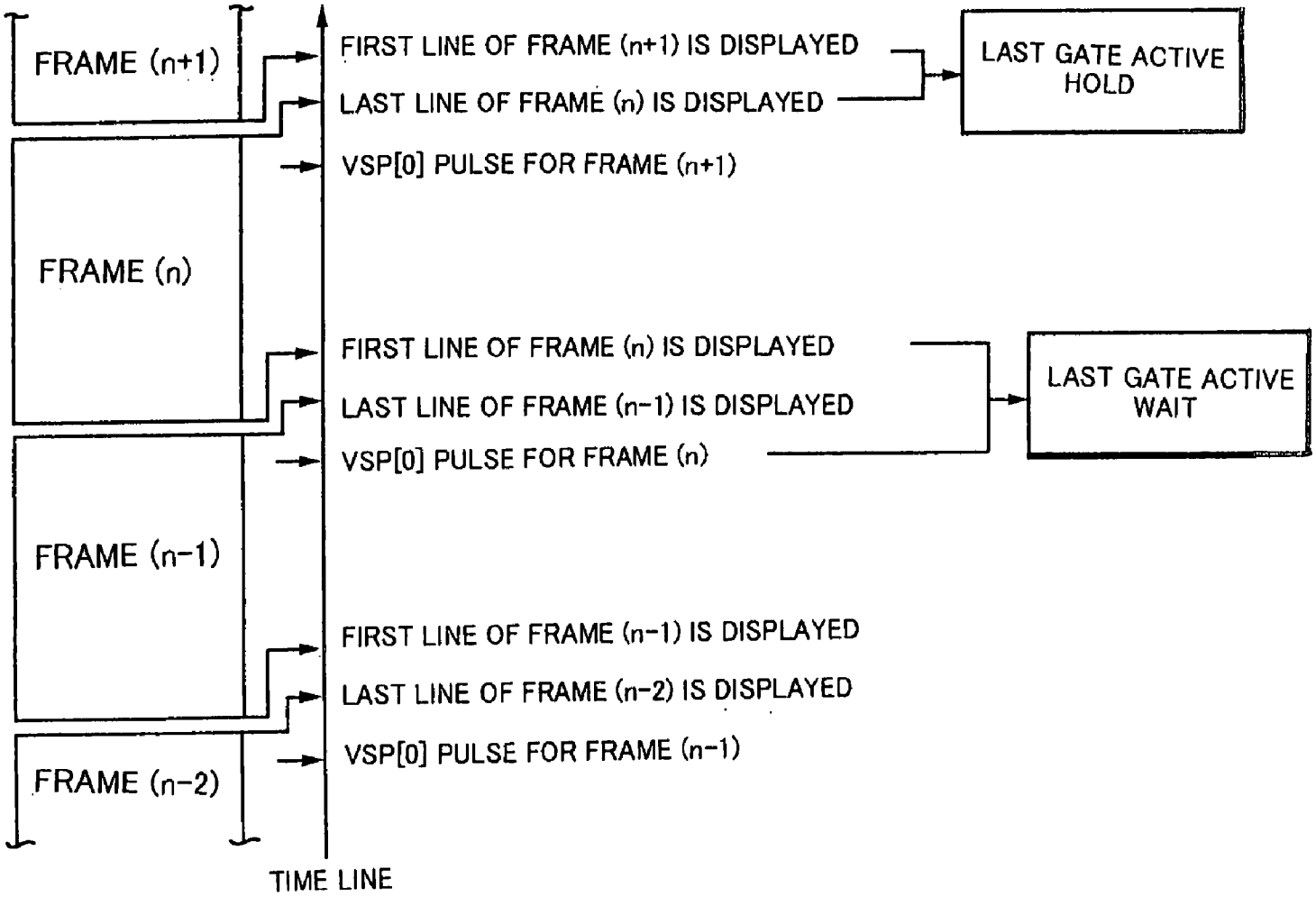
FIG. 20 is a visual model of the programmable gate driver timing controls associated with the integrated programmable FSC TFT LCD controller shown in FIG. 9.
Figure 21:
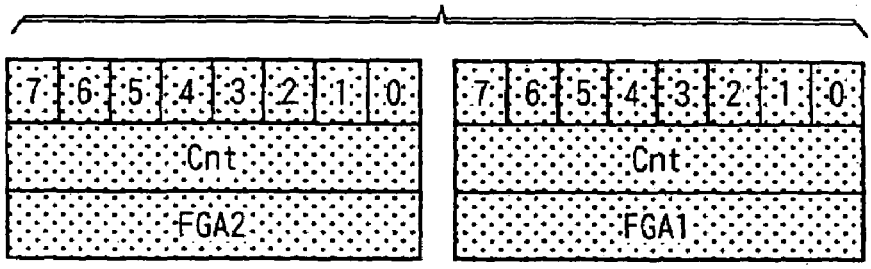
FIG. 21 illustrates a set of programmable first gate active registers suitable for use with the integrated programmable FSC TFT LCD controller shown in FIG. 9 to accommodate the visual model depicted in FIG. 20.

Gate drivers for TFT LCD displays require a few VSCLK pulses after the VSP[n] pulse before the first gate output "Out 1" becomes active. Further, the TFT LCD panel may need a few "line times" between frames to reverse voltage polarities or other current management operations. The Gate Driver Timing controls in the FSC-TFT display controller 100 allow for program control over these two variables with the First Gate Active (FGAn) and Last Gate Active (LGAn) registers shown in FIG. 21. FIG. 20 is a visual model showing the "First Gate Active" wait time and "Last Gate Active" hold time (see gray boxes) in graph form. If the VSP[l] pulse marks the beginning of a frame (field) time, then the frame overlap suggested by FIG. 20 must be accepted.

A "Line Time" begins with the active edge of the VSCLK clock and ends on the next active edge of the VSCLK. The values programmed in the register relating to the Gate Driver Timing Controls are in units of VSCLK clocks and they all start counting on the first active edge of VSCLK after VSP[1] goes low. If OPP.VSCLK=0, the active edge of VSCLK is the rising edge. If OPP.VSCLK=1, the active edge of VSCLK is the falling edge.

The "First Gate Active" wait time is measured in line times. The value programmed in the FGA1 register is the number of lines (i.e. VSCLK clocks) after the VSP[1] signal goes low before the first out pulse (i.e. OUT1 of gate driver 1 goes high) is generated by gate driver 1. If this value is zero, the very first active edge of VSCLK after the VSP[1] signal goes active marks the beginning of the first line of data to be output to the Source Driver 116*a*, 116*b*.

Figure 25:
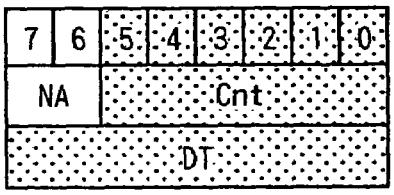
FIG. 25 illustrates a programmable register set suitable for use with the integrated programmable FSC TFT LCD controller shown in FIG. 9 to allow adjustment of the timing relationship between the gate driver output active time and the source driver data transfer timing.

The Transfer pulse (TP1) for the first line will be referenced to this active edge by the DT register shown in FIG. 25. The first line (equates to the line time just before Out1 in the Gate Driver 118*a*, 118*b* pulses low) of a new frame (or field) may he programmed to begin in the range between zero (0) and sixty three (63) VSCLK periods after the very first active edge of VSCLK while VSP[1] is still active.

The count is marked with the active edge of VSCLK. The value programmed in the FGA2 register is the number of lines (i.e. VSCLK clocks) after the active edge of VSP[l] signal goes active before the VSP[2] signal goes active (if there is a second gate in the system design). If FGA2 is programmed with a value less than what is programmed in FGA I, then VSP[2] will never go active.

Figure 22:
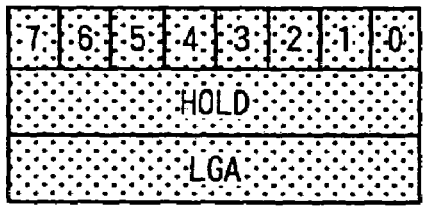
FIG. 22 illustrates a programmable last gate active register suitable for use with the integrated programmable FSC TFT LCD controller shown in FIG. 9 to accommodate the visual model depicted in FIG. 20.

The LGA registers illustrated in FIG. 22 define the last line of the previous frame (or field) relative to the first line of the next frame (or field). The value may be programmed to occur in the range between zero and 256 VSCLK periods before the first line of the next frame occurs.

The count is marked with the active edge of the VSCLK. A programmed value of zero (0) would indicate there are no "dead" line times between the last line of the previous frame and the first line of the next frame where LGA=Total Line Count−Total Active Lines. The LGA register could actually be viewed as a "line blanking" control. In the cases where frame overlap cannot be used, blank lines will need to be inserted.

Some gate drivers use the duty cycle of the VSCLK to determine the active time of a gate output. The outputs for these gate drivers are sinking current (driving) when the VSCLK is high and not sinking current (not driving) when it is low. During this "not driving" time of the gate outputs, the voltages output to the source driver may be changed or even reversed in polarity. Because different display panels have such diverse characteristics, this "not-driving" time cannot be standardized. Therefore, making it programmable in the OTCon 142 increases the number of different panels and panel vendors the LCD Controller 100 can support.

Figure 23:
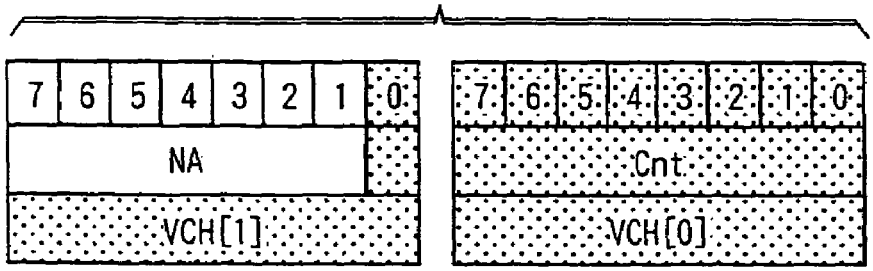
FIG. 23 illustrates a set of programmable registers suitable for use with the integrated programmable FSC TFT LCD controller shown in FIG. 9 to control the duty cycle of its vertical shift clock.
Figure 24:
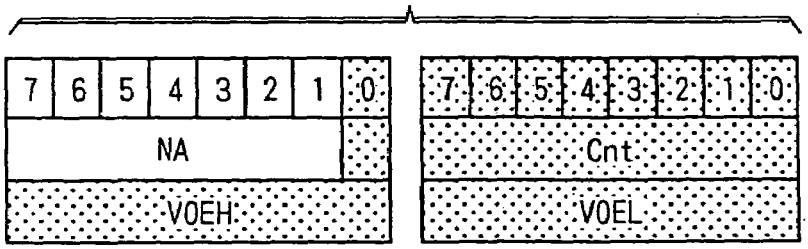
FIG. 24 illustrates a set of programmable registers suitable for use with the integrated programmable FSC TFT LCD controller shown in FIG. 9 to control the active time of a gate output.

The VCH[n] register set illustrated in FIG. 23 controls the duty cycle of VSCLK. The VCH[n] register set determines how many OutClkT periods the VSCLK clock is active during one VSCLK clock period. A value of zero results in the VSVLK clock active time being equal to one OutClkT period. The maximum value of 511 results in the VSCLK clock high time being equal to 512 OutClkT periods. This allows the VSCLK active time to have a range of between 1 and 512 OutClkT periods. The active time of the VSCLK clock is the time between the active edge and the inactive edge of the VSCLK clock. If the active edge is the rising edge of the clock, then the active time of VSCLK is the time VSCLK is high. The total period of VSCLK is equal to the values of the DRS register multiplied by the period (OutClkT) of the HSCLK.

The OutClkT period is the cycle time of the HSCLK. If the VCH register set is programmed with a value greater than the DRS register, the VSCLK clock will never go inactive.

Other gate drivers require an additional output signal, VOE, to determine the active time of a gate output. The outputs for these gate drivers are sinking current (driving) when the VOE signal is active and not sinking current (not driving) when it is inactive. The VOE[n] register set shown in FIG. 24 controls the active time of VOE. The VOE[n] register set determines how many OutClkT periods the VOE signal is active during one VSCLK clock period. A value of zero results in the VOE signal never being active. If VOE[n] is programmed to be active longer than one VSCLK clock period, it will automatically terminate one OutClkT period before the end of the VSCLK clock period.

Some program control is however necessary to adjust the timing relationship between the Gate Drivers Output Active time (VSCLK rising edge) and the Source Drivers Data transfer timing (TP1 rising edge). The DT register shown in FIG. 25 is added to allow this timing relationship to be adjusted to within one OutClkT period.

The value in this register will determine how many OutClkT periods after VSCLK goes active before the Transfer Pulse (TP1) goes active. The TP1 transfer pulse may be programmed to go active within a range between zero (0) and Sixty three (63) OutClkT periods after VSCLK goes active. This even occurs at the start of every display line.

If the DT register is programmed with a zero value, the TP1 pulse will go active on the same active edge of the HSCLK as does the VSCLK clock (when VSP[1] is low). If the DT register is programmed with a value of one, the TP1 pulse will go active one HSCLK period after VSCLK goes active. This even occurs at the start of every display line.

Figure 26:
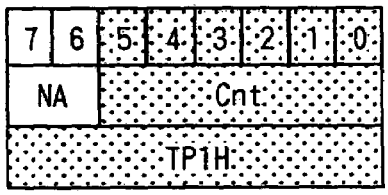
FIG. 26 illustrates a programmable register set suitable for use with the integrated programmable FSC TFT LCD controller shown in FIG. 9 to further enhance the timing relationship controlled via the programmable register set shown in FIG. 25.

The TP1H register shown in FIG. 26 defines the number of HSCLK clock cycles the TP1 signal is active. The TP1 signal is active for (TP1H.Cnt+1) HSCLK cycles. If TP1H.Cnt=0, TP1 is active for one HSCLK clock cycle. The TP1 transfer pulse may be programmed to be active within a range between one and Sixty-four OutClkT periods. This even occurs at the start of every display line.

The present inventors found it necessary to provide a way to determine the time period after the Transfer Pulse (TP1) occurs before the shift register gets cleared in the Source Driver 116*a*, 116*b* for each Source Driver 116*a*, 116*b*.

Figure 27:
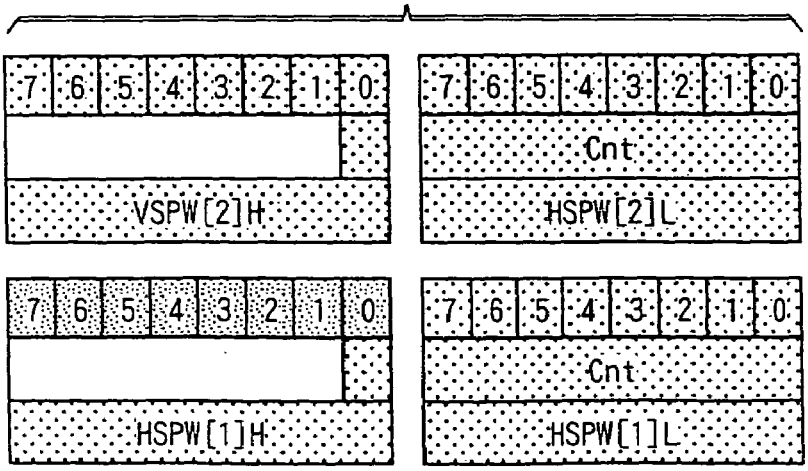
FIG. 27 illustrates a programmable register set suitable for use with the integrated programmable FSC TFT LCD controller shown in FIG. 9 to determine how long after a transfer pulse occurs before the shift register gets cleared in the source driver for each source driver.
Figure 33:
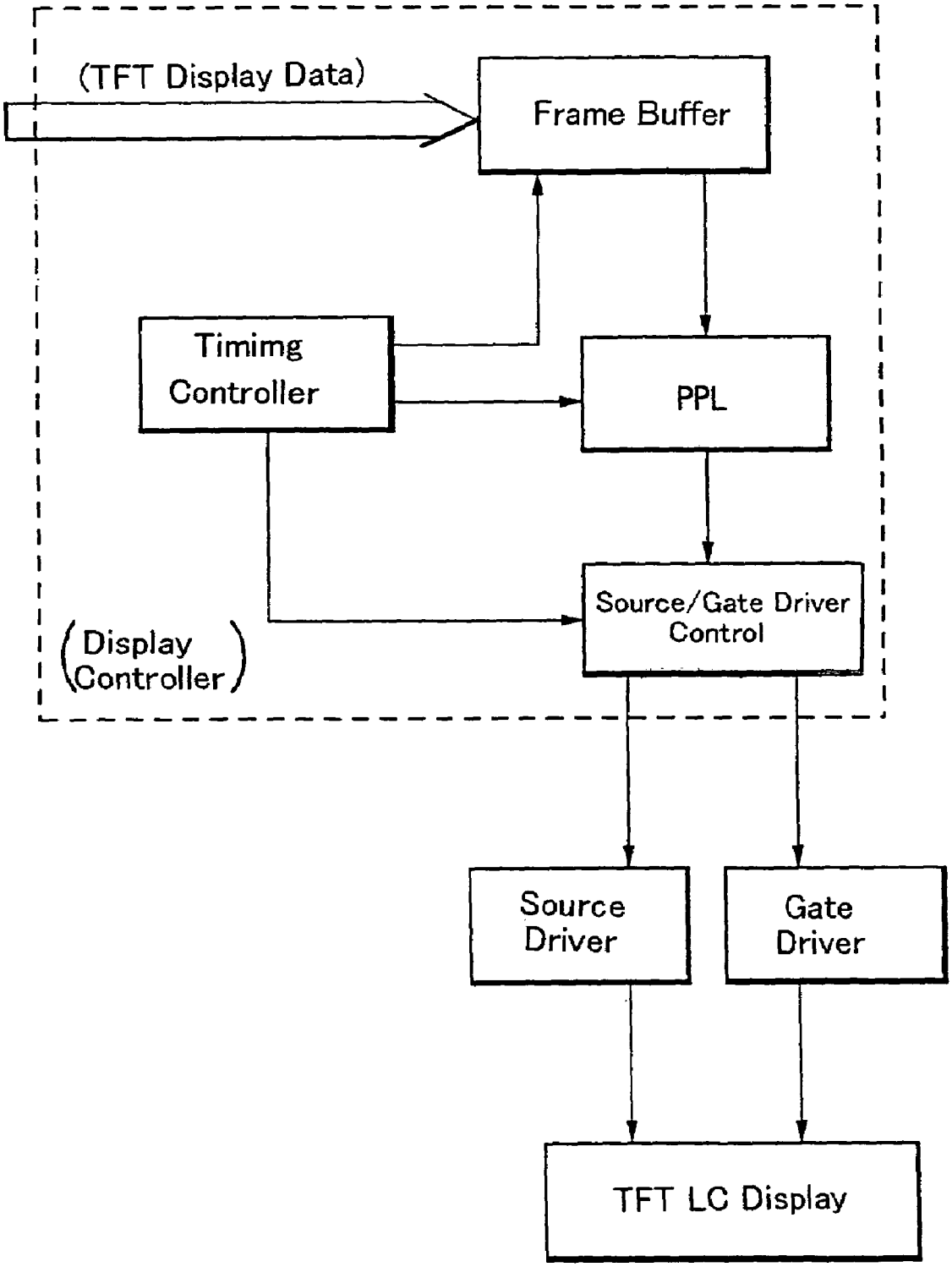
FIG. 33 is a block diagram showing the basic configuration of the controller according to the present invention.

The HSPW[n] registers shown in FIG. 27 define this parameter for each HSP signal in terms of HSCLK clock cycles. The active edge of the HSP[n] signal may be programmed to occur in the range between zero and 511 HSCLK periods after the active clock edge of HSCLK that sets TP1 high. If HSPW[n] is programmed with a zero value, the same active HSCLK clock edge that sets TP1 active will be used to set HSP[n] active. If HSPW[n] is programmed with a value of one, the first active HSCLK clock edge after TP1 has been set active will be used to set HSP[n] active.

The present inventors also found it necessary to provide a way to determine the time period after the HSP[1] pulse occurs in a source driver before valid data to Source Driver 116*a* can begin.

The NLA register shown in FIG. 28 define this parameter for the HSP[1] signal in terms of HSCLK clock cycles. The data may then be delayed in the range between zero and sixteen HSCLK periods from the active edge of HSCLK that sets the HSP[1] signal active. If the NLA register is programmed with a zero value, the same HSCLK clock edge that sets HSP[1] active will be used to place the first valid data of a line on the CH[n][m] bus.

If the NLA register is programmed with a value of one, the first HSCLK clock edge after HSP[1] gets set active will be used to place the first valid data of a line on the CH[n] [m] bus. This even occurs at the start of every display line. The Enable Input Wait and Next Line Active program controls can be viewed as a pixel blanking feature. Together they define the number of blank pixels in a line.

The LDA register shown in FIG. 29 defines how many remaining HSCLK clock cycles after the LAST valid data for a line is placed on the CH[n] [m] bus and the first active edge of HSCLK after TP1 pulse goes active for that line.

The TP1 signal will go active to transfer the data into the Source Drivers 116*a*, 116*b* output buffer. The LDA.Cnt value defines the number of valid HSCLK clock cycles remaining in a line of data after the LAST valid data of a line is output.

The first active edge of the HSCLK signal after TP1 goes high is "LDA.Cnt+1" HSCLK clock cycles after the last valid output of a line is clocked onto the CH[n][m] bus by the active edge of the HSCLK clock. If LDA is zero, the TP1 signal goes active on the same HSCLK rising clock edge that latches the last pixel on to the CH[n] [m] bus.

If LDA is one, the TP1 signal goes active on the active HSCLK edge that occurs one clock cycle after the last pixel on the CH[n] [m] bus. This even occurs at the end of every display line.

As stated herein before, the Output Timing Controller (OTCon) 142 shown in FIG. 10 is the source of all generated clocks and power management controls. A number of special power management and display transition timing settings are defined by just two registers, the PMC (Power Management Controls) register 160 discussed herein before with reference to FIG. 12, and a MFC (Master Field Controls) register that is implemented within the OTCon 142. Moving now to FIG. 30, the REV Master register will determine if the REV signal is toggling on every line or every Frame. An FSC TFT Frame Toggle is set, for example, when REVMT.T=00.

The REV signal will then toggle according to the FC value in the MFC register discussed above. There are up to three toggling schemes (one 3-field frame and two 4-field frames) defined in the MFC register. The VSP[1] pulse associated with the RED sub-field will always trigger the REV toggle. The REV signal is toggled on the active edge of the VSCLK REVW.cnt clock cycles after the first active edge of VSCLK after VSP[1] goes active.

According to one embodiment, REVM must be set to this value when the LCD controller 100 is used in a FSC TFT LCD display application. For "StandBy" and "Low Power" modes, FSC TFT Frame toggle is the same as Non-FSC TFT Frame toggle.

A non-FSC TFT Frame Toggle is set when REVM.T=10. The REV signal will toggle on every VSP[1] pulse. The REV signal is toggled on the active edge of VSCLK REVM.cont clocks after the first active edge VSCLK while VSP[1] is active.

A non-FSC TFT Line Toggle is set when REVM.T=11. The REV signal is toggled on the first active edge of HSCLK while VSP[1] is active.

The REVW register shown in FIG. 31 is used when REVM.T=XO (Frame Toggle). This register defines the number of VSCLK clocks to wait after the first active edge of VSCLK after VSP[1] goes active before toggling the REV signal. If REVW.Cnt=0, the first active edge of VSCLK after VSP[1] goes active marks when the REV signal toggles.

The polarity of some of the output pins associated with the display controller 100 described herein above with reference to FIGS. 8 through 32 may be programmable selectable. The Output Pin Polarity (OPP) registers shown in FIG. 32 are provided to define the polarity selection of these pins. One embodiment is defined as follows:

OPP.HP: Polarity Selection for the Pins HSP[1, 2]
0—HSP[1] and HSP[2] are active low signals.
1=HSP[1] and HSP[2] are active high signals.

OPP.TP: Polarity Selection for the Pin TP1
0=TP1 is an active low signal.
1=TP1 is an active high signal.

OPP.VP: Polarity Selection for the Pins VSP[1, 2]
0=VSP[1] and VSP[2] are active low signals.
1=VSP[1] and VSP[2] are active high signals.

OPP.OE: Polarity Selection for the Pin VOE
0=VOE is an active low signal.
1=VOE is an active high signal.

OPP.VC: Polarity Selection for the Pin VSCLK
0=The active edge of the VSCLK is the falling edge (high to low transition).
1=The active edge of the VSCLK is the rising edge (low to high transition).

OPPHC: Polarity Selection for the Pin HSCLK
0=Tile active edge of the HSCLK is the falling edge (high to low transition).
1=The active edge of the HSCLK is the rising edge (low to high transition).

In summary explanation, as can be seen from the register definitions above and the waveform timings they control, discussed herein above with particular reference to FIG. 19, there is no standard way of controlling gate or source drivers. In order to be cost effective, it is crucial that FSC TFT and non-FSC TFT display controllers be integrated in a manner amenable to interfacing with and controlling a wide variety of gate and source drivers.

The specific techniques disclosed herein to achieve this goal have been implemented via a programmable gate and source driver interface, among other things. The Power Management Controls (PMC) register, for example, has a wide-ranging effect across all the components in the display controller 100.

In some cases, it forced components, the Pixel Pipe Line 106, for example, into restricted modes of operation. In other cases, it forced components, the TCon 114 unit for example, to switch between sets of programmable registers for control. It can even shut down some components, for example, the PLL 162. This is a powerful feature for portable devices such as cell phones and PDAs, since this feature allows the operating system to change the personality and power consumption of the display device with a single write operation to one register. It is easily recognized and appreciated that this feature could not be realized and still be cost effective if all the components were not integrated onto the same die.

Further, the ability to control the intensity of the back light by controlling its on-off duty cycle relationship has never been done before. Up until now, back light intensity has been controlled by regulating the voltage to the back light.

Programmable gate and source driver timing has never herein before been used in association with display device controllers. Until now, every LCD display panel has been required to function in response to a unique timing controller tailored to meet the needs of the specific display panel. The programmable timing controls in the display controller 100 are therefore a significant advancement in the display timing controller art rendering known design idioms obsolete and non-competitive.

In view of the above, it can be seen the present invention presents a significant advancement in the art of Field Sequential Color TFT and non-FSC TFT display devices. Further, this invention has been described in considerable detail in order to provide those skilled in the FSC TFT and non-FSC TFT controller art with the information needed to apply the novel principles and to construct and use such specialized components as are required. In view of the foregoing descriptions, it should be apparent that the present invention represents a significant departure from the prior art in construction and operation. However, while particular embodiments of the present invention have been described herein in detail, it is to be understood that various alterations, modifications and substitutions can be made therein without departing in any way from the spirit and scope of the present invention, as defined in the claims which follow.

What is claimed is:

1. A TFT display controller comprising:

a frame buffer operational to store TFT display data supplied from outside;

a timing controller;

a pixel pipe line (PPL) operational in response to signals generated by the timing controller to fetch and convert the TFT display data to a desired TFT display format; and TFT display source/gate driver controls operational in response to signals generated by the timing controller to control representation of the TFT display data, wherein all of the frame buffer, timing controller, pixel pipe line and TFT display source/gate driver controls are incorporated onto a single die, and wherein the PPL outputs fixed data independent from the TFT display data to the source/gate driver controls in response to signals generated by the timing controller; wherein the timing controller switches the output of the TFT display data of the converted format from the PPL and the output of the fixed data in a constant cycle and a constant ratio time.

2. The TFT display controller according to claim 1 wherein black is displayed based on the fixed data.

3. The TFT display controller according to claim 1 further comprising a means for determining a frequency for representation of the converted TFT display data on the TFT display, wherein the means for determining a frequency includes a programmable phase lock loop.

4. The TFT display controller according to claim 1 wherein the constant period and the constant ratio of time are programmable.

5. The TFT display controller according to claim 1 further comprising a power management control (PMC) register for a plurality of power management modes, wherein the output of the TFT display data and the output of the fixed data are switched cyclically with a constant cycle and a constant ratio of time that are independent for each power management mode.

6. A TFT display controller comprising:

a frame buffer operational to store TFT display data supplied from outside;

a timing controller;

a pixel pipe line (PPL) operational in response to signals generated by the timing controller to fetch and convert the TFT display data to a desired TFT display format; and TFT display source/gate driver controls operational in response to signals generated by the timing controller to control representation of the TFT display, wherein all of the frame buffer, timing controller, pixel pipe line and TFT display source/gate driver controls are incorporated onto a single die, and wherein the PPL can be switched by the timing controller between a mode for FSC-TFT display and a mode for non-FSC-TFT display.

7. The TFT display controller according to claim 6 wherein the mode for FSC-TFT display is a display format including at least one color field for each of three colors in each frame, and wherein the mode for non-FSC-TFT display is a display format in which each frame is composed of one color field.

8. The TFT display controller according to claim 7 wherein the TFT display controller has a plurality of power management modes, and wherein the mode for FSC-TFT display and the mode for non-FSC-TFT display are switched by the power management modes.

9. A TFT display controller comprising:

a programmable timing controller;

a programmable pixel pipe line (PPL) operational in response to signals generated by the programmable timing controller to fetch and convert the TFT display data to a desired TFT display format;

a programmable color light sequencer operational in response to signals generated by the programmable timing controller to control a TFT display back light; and programmable TFT display source/gate driver controls operational in response to signals generated by the programmable timing controller to control representation of the TFT display data converted by the PPL on a desired TFT display selected from the group consisting of a field sequential color TFT display and a non-field sequential color TFT display.

10. The TFT display controller according to claim 9 wherein the frame buffer, PPL, color light sequencer, programmable source/gate driver controls and programmable timing controller are integrated onto a single die.

11. The TFT display controller according to claim 9 further comprising a programmable phase lock loop responsive to data stored therein to determine a frequency for representation of the TFT display data converted by the PPL.

12. The TFT display controller according to claim 9 wherein the PPL comprises a plurality of parallel pixel pipes.

13. The TFT display controller according to claim 12 wherein the PPL further comprises white and black fixed color data registers.

14. The TFT display controller according to claim 12 wherein the PPL further comprises path select logic having a display raster setting (DRS) register, wherein data stored in the DRS register determines the desired TFT display format.

15. The TFT display controller according to claim 9 further comprising a power management control (PMC) register, wherein data stored in the PMC register determines an output frequency associated with a PLL such that the PLL controls PPL data paths to manage power consumption of the PPL.

16. The TFT display controller according to claim 9 wherein the programmable timing controller comprises field controls and sub-field controls operational to generate field and sub-field timing signals for the PPL and the back light.

17. The TFT display controller according to claim 9 wherein the representation of the field sequential color TFT display includes at least one color field for each of three colors in each frame, and wherein the representation of the non-field sequential color TFT display includes frames each consisting of one color field.

18. The TFT display controller according to claim 17 wherein the TFT display controller has a plurality of power management modes, and wherein the representation of the field sequential color TFT display and the representation of the non-field sequential color TFT display are switched by the power management modes.

19. A TFT display controller comprising:

means for storing TFT display data;

means for storing power management control data;

means for generating timing control signals;

means for fetching and converting the TFT display data to a desired TFT display format in response to the timing control signals;

means for controlling a TFT display backlight in response to the timing control signals;

means responsive to the timing control signals to control representation of the converted TFT display data on a desired TFT display selected from the group consisting of a field sequential color TFT display and a non-field sequential color TFT display; and means for determining a frequency for representation of the converted TFT display data in response to data stored in the means for storing power management control data, wherein the means for storing TFT data, means for generating timing control signals and means for fetching and converting the TFT display data to a desired TFT format are integrated onto a single die.

20. The TFT display controller according to claim 19 wherein the means for fetching and converting the TFT display data to a desired TFT display format comprises a programmable pixel pipe line which includes white and black fixed color data registers.

21. The TFT display controller according to claim 19 wherein the means for determining a frequency for representation of the converted TFT display data on the TFT display comprises a programmable phase lock loop.

22. The TFT display controller according to claim 19 wherein the representation of the field sequential color TFT display includes at least one color field for each of three colors in each frame, and wherein the representation of the non-field sequential color TFT display includes frames each consisting of one color field.

23. The TFT display controller according to claim 22 wherein the representation of the field sequential color TFT display and the representation of the non-field sequential color TFT display are switched in response to the data stored by the means for storing power management control data.

* * * * *